US010219585B2

(12) United States Patent
Taylor

(10) Patent No.: US 10,219,585 B2
(45) Date of Patent: Mar. 5, 2019

(54) BELT BUCKLE WITH INTEGRATED TOOL

(71) Applicant: SlideBelts Inc., El Dorado Hills, CA (US)

(72) Inventor: Brigham Thomas Taylor, El Dorado Hills, CA (US)

(73) Assignee: SLIDEBELTS INC., El Dorado Hills, CA (US)

( * ) Notice: Subject to any disclaimer, the term of this patent is extended or adjusted under 35 U.S.C. 154(b) by 170 days.

(21) Appl. No.: 15/215,522

(22) Filed: Jul. 20, 2016

(65) Prior Publication Data

US 2017/0020234 A1 Jan. 26, 2017

Related U.S. Application Data

(60) Provisional application No. 62/195,205, filed on Jul. 21, 2015.

(51) Int. Cl.

| | |
|---|---|
| ***A44B 11/00*** | (2006.01) |
| ***A44B 11/20*** | (2006.01) |
| ***B25F 1/00*** | (2006.01) |
| ***A44B 11/12*** | (2006.01) |
| ***A44B 11/06*** | (2006.01) |

(Continued)

(52) U.S. Cl.

CPC ..... *A44B 11/005* (2013.01); *A44B 11/006* (2013.01); *A44B 11/06* (2013.01); *A44B 11/20* (2013.01); *A44B 11/2526* (2013.01); *A44B 11/2557* (2013.01); *B25F 1/00* (2013.01); *B25F 1/04* (2013.01)

(58) Field of Classification Search

CPC ... A44B 11/005; A44B 11/2557; A44B 11/06; A44B 11/2526; A44B 11/006; A44B 11/20; A44B 11/12; A44B 11/125; B25F 1/04; B25F 1/00; A41F 9/002; A41F 9/02; Y10S 24/48; Y10T 24/45194; Y10T 24/4016; Y10T 24/4072

See application file for complete search history.

(56) References Cited

U.S. PATENT DOCUMENTS

| | | | | |
|---|---|---|---|---|
| 1,578,468 A * | 3/1926 | Rankin | ..... | A44B 11/005 206/101 |
| 1,887,825 A * | 11/1932 | Statham | ..... | A41F 1/008 24/593.11 |
| D245,830 S | 9/1977 | de Gross | | |

(Continued)

*Primary Examiner* — Robert Sandy
*Assistant Examiner* — Rowland Do
(74) *Attorney, Agent, or Firm* — Knobbe, Martens, Olson & Bear, LLP

(57) ABSTRACT

The present application includes embodiments for a belt adjustment system. The belt adjustment system can be configured to engage a belt comprising a plurality of belt teeth. The belt engagement system can include a buckle portion that includes a belt clamp configured to couple the belt to the buckle, a lever pivotally movable between a first position and a second position, and a belt-engaging tab, the tooth-engaging tab positionable between a tooth-engaging position and a tooth-disengaging position responsive to the position of the lever on. The belt adjustment system can include a tool housing having a first wall and a second wall that form a slot. A tool comprising a distal end and a proximal end can be coupled to the tool housing, the tool positionable within the slot between a closed position and an open position.

19 Claims, 23 Drawing Sheets

(51) Int. Cl.
*A44B 11/25* (2006.01)
*B25F 1/04* (2006.01)

(56) References Cited

U.S. PATENT DOCUMENTS

| | | | | | |
|---|---|---|---|---|---|
| 4,078,272 | A * | 3/1978 | Mahon, III | B26B 1/02 | 24/186 |
| 4,669,155 | A * | 6/1987 | Chen | A41F 9/002 | 24/170 |
| 5,123,579 | A * | 6/1992 | Sugiyama | A44B 11/005 | 224/163 |
| 5,572,747 | A * | 11/1996 | Cheng | A44B 11/12 | 2/312 |
| 5,579,563 | A * | 12/1996 | Sim | A41F 9/002 | 24/170 |
| 5,588,186 | A * | 12/1996 | Ko | A44B 11/14 | 24/170 |
| 5,609,281 | A * | 3/1997 | West | A44B 11/005 | 224/163 |
| 6,145,994 | A * | 11/2000 | Ng | B25F 1/02 | 206/234 |
| D452,123 | S | 12/2001 | Kelleghan | | |
| D520,825 | S | 5/2006 | Kelleghan | | |
| 8,707,490 | B1 | 4/2014 | Pelton | | |
| 9,149,090 | B1 * | 10/2015 | Taylor | A41F 9/02 | |
| 9,277,776 | B2 * | 3/2016 | Laatz | A44B 11/125 | |
| 9,351,526 | B1 * | 5/2016 | Taylor | A44B 11/12 | |
| 9,615,631 | B2 * | 4/2017 | Laatz | A41F 9/025 | |
| 2012/0036618 | A1 * | 2/2012 | Rowland | A41F 9/025 | 2/311 |
| 2013/0167288 | A1 * | 7/2013 | Rowland | A41F 9/002 | 2/338 |
| 2016/0255916 | A1 * | 9/2016 | Ozdowy | A44B 11/005 | |

* cited by examiner

BELT BUCKLE WITH INTEGRATED TOOL

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Conventional belt adjustment systems may utilize a single lever which actuates an adjustment mechanism that interacts with grooved teeth on a belt. Such an adjustment mechanism allows the belt to be adjusted along a continuum of diameters to accommodate waists of corresponding sizes. However, utilization of a single lever to actuate the adjustment mechanism may be cumbersome for some users. Due to the manner in which the adjustment mechanism interacts with the teeth in the belt, the user may be required to depress the lever of the buckle with extreme force while dislodging the belt from the adjustment mechanism in a back-and-forth motion.

SUMMARY OF SOME EMBODIMENTS

The systems, methods, and devices of this disclosure each have several innovative aspects, no single one of which is solely responsible for the all of the desirable attributes disclosed herein.

One embodiment discloses a belt adjustment system, comprising: a belt comprising a plurality of belt teeth; a buckle comprising: a belt clamp configured to couple the belt to the buckle; a lever movable between a first position and a second position; a tooth-engaging tab, the tooth-engaging tab positionable between a tooth-engaging position when the lever is in the first position, and a tooth-disengaging position the lever is in the second position; a tool housing comprising a first wall and a second wall, a slot formed between the first wall and the second wall; and a tool comprising a distal end and a proximal end, wherein the proximal end is coupled to the tool housing, the tool positionable between a closed position and an open position.

Another embodiment discloses a belt adjustment system, comprising: a buckle frame portion comprising: a belt clamp configured to couple a belt to the belt adjustment system; a lever movable between a first position and a second position; a belt-engaging tab, the belt-engaging tab positionable between a belt-engaging position when the lever is in the first position, and a belt-disengaging position the lever is in the second position, wherein the belt-engaging tab is configured to engage a belt positioned within a belt space of the belt adjustment system; a tool housing portion comprising: a first wall and a second wall, a slot formed between the first wall and the second wall; and a tool comprising a distal end and a proximal end, wherein the proximal end is coupled to the tool housing, the tool positionable between a closed position and an open position.

Although certain embodiments and examples are disclosed herein, inventive subject matter extends beyond the examples in the specifically disclosed embodiments to other alternative embodiments and/or uses, and to modifications and equivalents thereof.

BRIEF DESCRIPTION OF THE DRAWINGS

Illustrative embodiments of the disclosure will now be described, by way of example, with reference to the accompanying drawings, in which.

DETAILED DESCRIPTION OF EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is nonlimiting and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which can be claimed. Furthermore, there is no intention to be bound by any expressed or implied theory presented in the preceding technical field, background, brief summary or the following detailed description. Relative terms such as "front" and "rear" as used herein are intended for descriptive purposes only and are not necessarily intended to be construed in a limiting sense.

Figure 8:
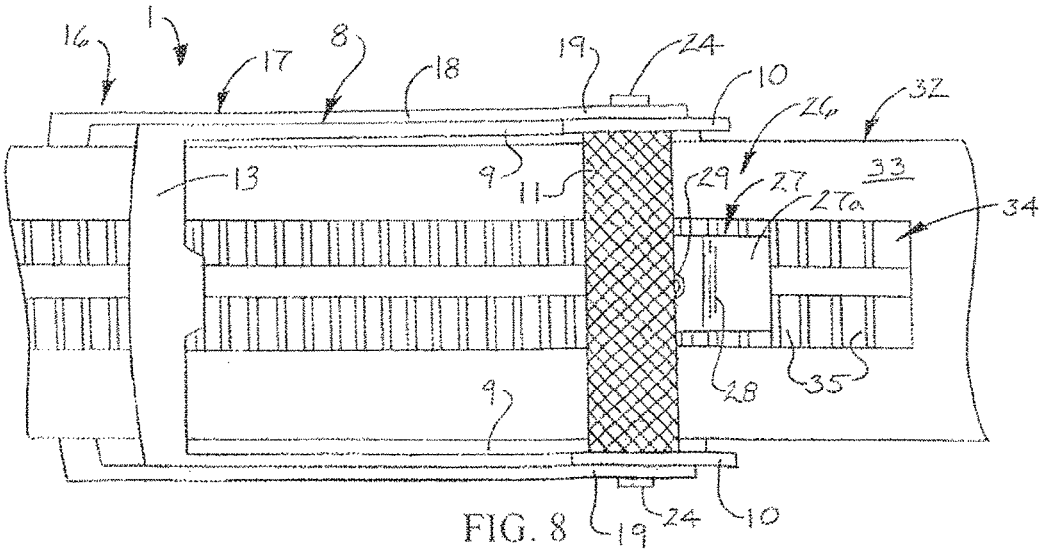
FIG. 8 is a bottom view of an illustrative embodiment of the belt adjustment system provided on a belt.
Figure 11:
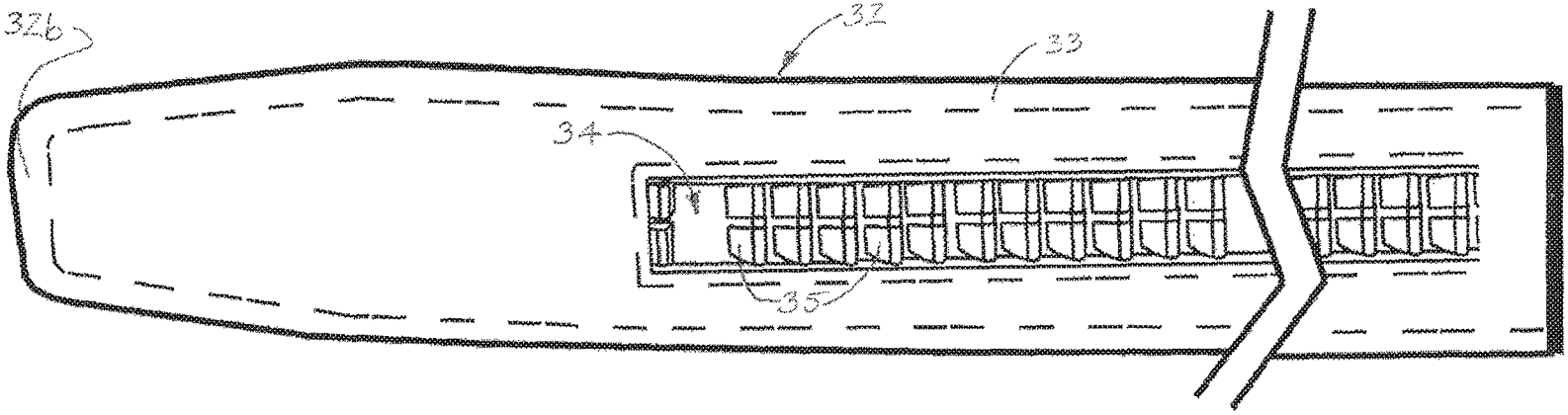
FIG. 11 is a view of the inside surface of an exemplary belt, partially in section, which is suitable for implementation of an illustrative embodiment of the belt adjustment system.
Figure 12:
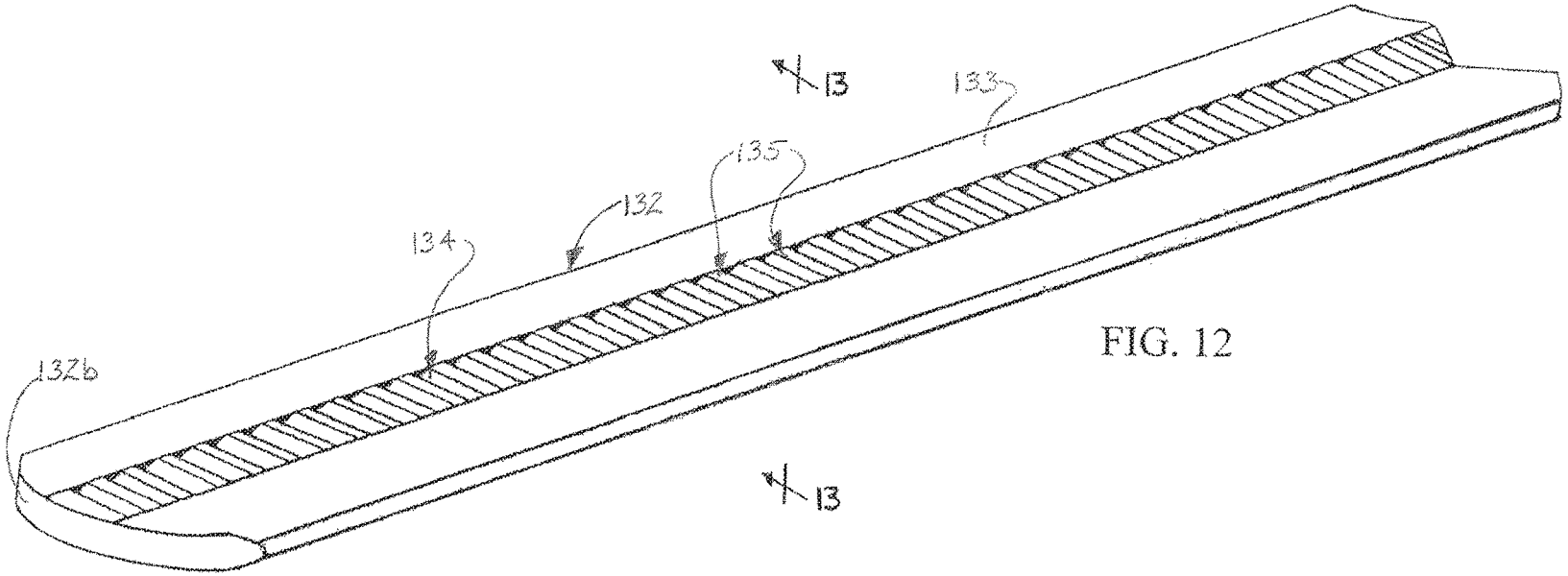
FIG. 12 is a perspective view of the inside surface of an alternative exemplary belt, partially in section, which is suitable for implementation of an illustrative embodiment of the belt adjustment system.

Referring to the drawings, an illustrative embodiment of the belt adjustment system is generally indicated by reference numeral 1. As will be hereinafter described, the belt adjustment system 1 facilitates ease and convenience for a user (not illustrated) in selective adjustment of a belt 32 around the waist of a user. As illustrated in FIGS. 8 and 11, the belt 32 may have an inside belt surface 33 which faces the waist of the user. An elongated belt groove 34 extends along at least a portion of the inside belt surface 33. Multiple, spaced-apart belt teeth 35, which may be plastic or other material, are provided in the belt groove 34. The belt adjustment system 1 engages the belt teeth 35 in the belt groove 34 to secure the belt 32 at a selected diameter around the waist of the user, as will be hereinafter further described.

Figure 1:
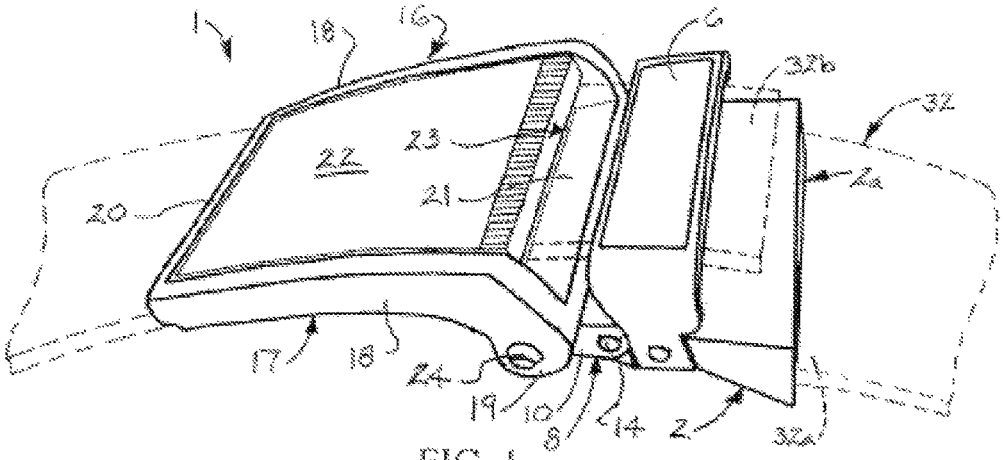
FIG. 1 is a top perspective view of an illustrative embodiment of the belt adjustment system provided on a belt.

As illustrated in FIGS. 1-5, the belt adjustment system 1 includes a belt clamp 2. In some embodiments, the belt clamp 2 may have a belt clamp interior 2*a* (FIG. 1). A tab opening 5 (FIG. 2) in the belt clamp 2 may communicate with the clamp interior 2*a*. A belt tooth tab 3 may be pivotally attached to the belt clamp 2 adjacent to the tab opening 5. Multiple belt teeth 4 may extend from the belt tooth tab 3. The belt tooth tab 3 may be positional between an open, belt-releasing configuration illustrated in FIG. 2, in which the belt tooth tab 3 is unseated from the tab opening 5 and the belt teeth 4 are disposed outside the belt clamp interior 2*a*, and a closed, belt-engaging configuration (FIG. 1) in which the belt tooth tab 3 is seated in the tab opening 5 and the belt teeth 4 extend into the belt clamp interior 2*a*. In use of the belt adjustment system 1, which will be hereinafter described, the belt teeth 4 are adapted to engage and secure an attachment end 32*a* of the belt 32 (illustrated in phantom) which is inserted in the belt clamp interior 2*a* of the belt clamp 2 to attach the belt adjustment system 1 to the belt 32. A belt stay 6 may be attached to the belt clamp 2 to secure a free adjustable end 32*b* of the belt 32, as will be hereinafter described. In other embodiments, the belt clamp 2 may have any design which facilitates attachment of the belt adjustment system 1 to the attachment end 32*a* of the belt 32 according to the knowledge of those skilled in the art.

Figure 2:
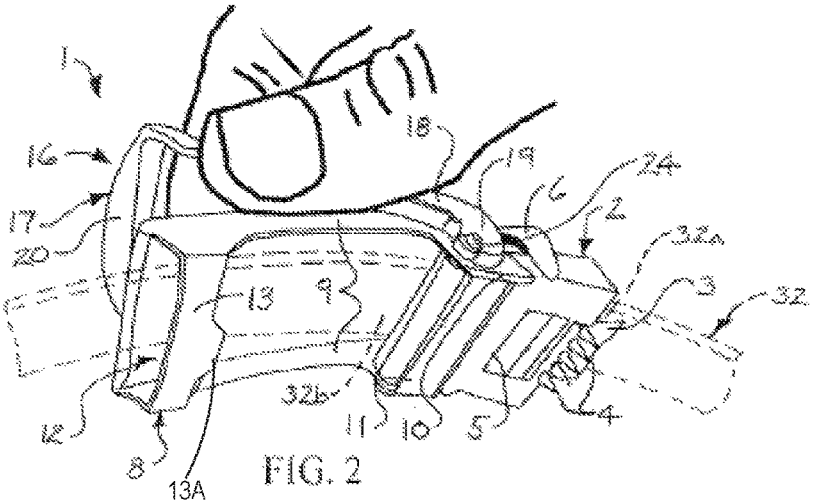
FIG. 2 is a bottom perspective view of an illustrative embodiment of the belt adjustment system provided on a belt.
Figure 4:
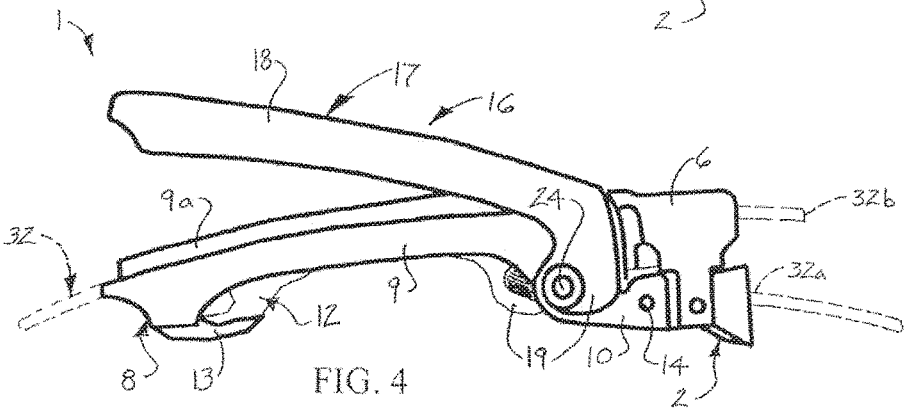
FIG. 4 is a side view of an illustrative embodiment of the belt adjustment system, provided on a belt and deployed in a belt-releasing configuration.
Figure 5:
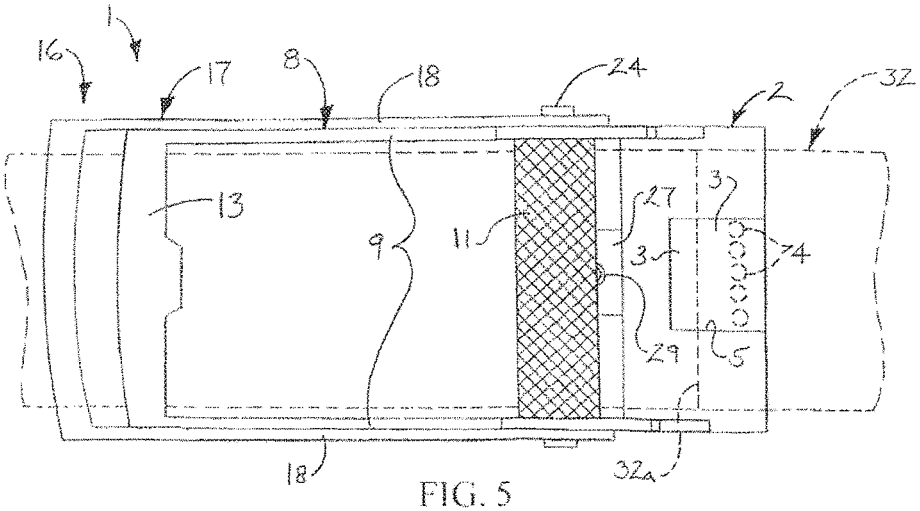
FIG. 5 is a bottom view of an illustrative embodiment of the belt adjustment system, provided on a belt.

A buckle 8 is attached to the belt clamp 2. As illustrated in FIG. 2, the buckle 8 may include a pair of elongated, parallel, spaced-apart side buckle members 9 which terminate in a pair of buckle flanges 10, respectively. The buckle flanges 10 may be attached to opposite sides of the belt clamp 2 such as via a pair of buckle fasteners 14. As further illustrated in FIG. 2, a front connecting member 11 and a rear connecting member 13 may extend between the side buckle members 9 in generally parallel, spaced-apart relationship to each other. The side buckle members 9, the front connecting member 11 and the rear connecting member 13 together form a belt space 12 which accommodates the adjustment end 32*b* of the belt 32. In some embodiments, a pair of lever seat flanges 9*a* (one of which is illustrated in FIG. 4) may extend from the respective side buckle members 9 for purposes which will be hereinafter described.

Figure 9:
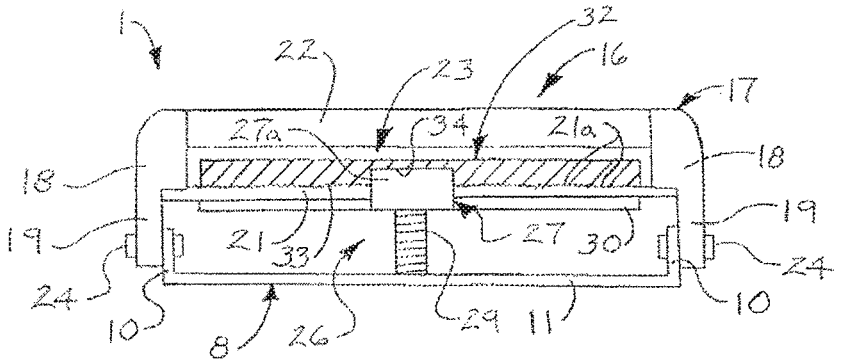
FIG. 9 is a front view, taken along viewing lines 9-9 in FIG. 6, of an illustrative embodiment of the belt adjustment system deployed in the belt-securing configuration.
Figure 10:
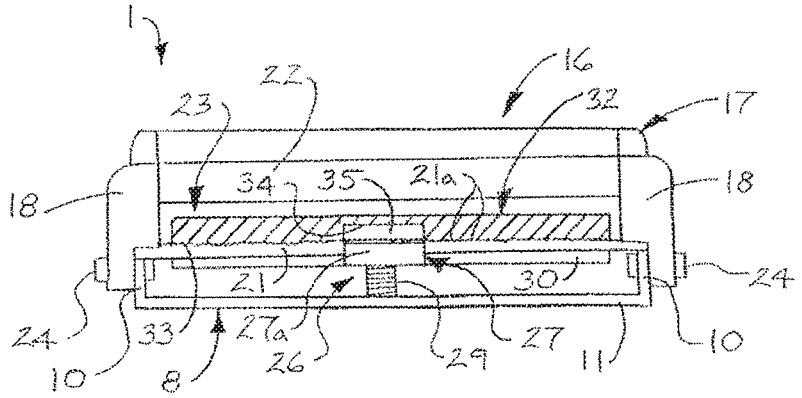
FIG. 10 is a front view, taken along viewing lines 10-10 in FIG. 7, of an illustrative embodiment of the belt adjustment system deployed in the belt-releasing configuration.

A lever 16 is pivotally attached to the buckle 8. As illustrated in FIG. 1, the lever 16 may include a lever frame 17 which may be generally elongated and rectangular. The lever frame 17 may have a pair of generally elongated, parallel, spaced-apart side lever frame members 18 which terminate in a pair of lever frame flanges 19. The lever frame flanges 19 may be pivotally attached to the buckle flanges 10, respectively, of the buckle 8 via pivot pins 24. A connecting frame member 20 may extend between the spaced-apart rear ends of the side lever frame members 18. As illustrated in FIG. 1, a belt engaging member 21 extends between the spaced-apart lever frame flanges 19 on the respective front ends of the side lever frame members 18. Accordingly, as the lever 16 is pivoted between the belt-securing configuration illustrated in FIGS. 3 and 9 and the belt-releasing configuration illustrated in FIGS. 4 and 10, the belt engaging member 21 pivots along with the lever 16. A lever plate 22 may be mounted in the lever frame 17. As illustrated in FIGS. 9 and 10, a belt slot 23 may be formed by and between the side lever frame members 18, the belt-engaging member 21, and the lever plate 22. The belt slot 23 is sized and configured to accommodate the belt 32 in use of the belt adjustment system 1. Multiple serrations

21*a* may be provided on the belt engaging member 21 in facing relationship to the belt slot 23.

Figure 6:
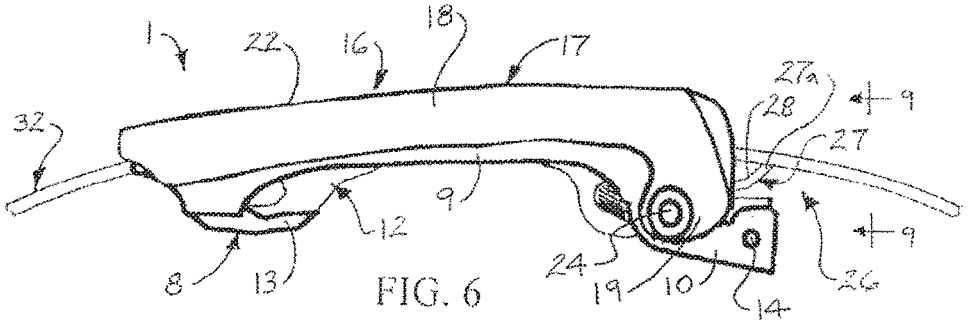
FIG. 6 is a side view of an illustrative embodiment of the belt adjustment system provided on a belt and deployed in the belt-securing configuration, with a belt clamp removed from the belt adjustment system for clarity.
Figure 7:
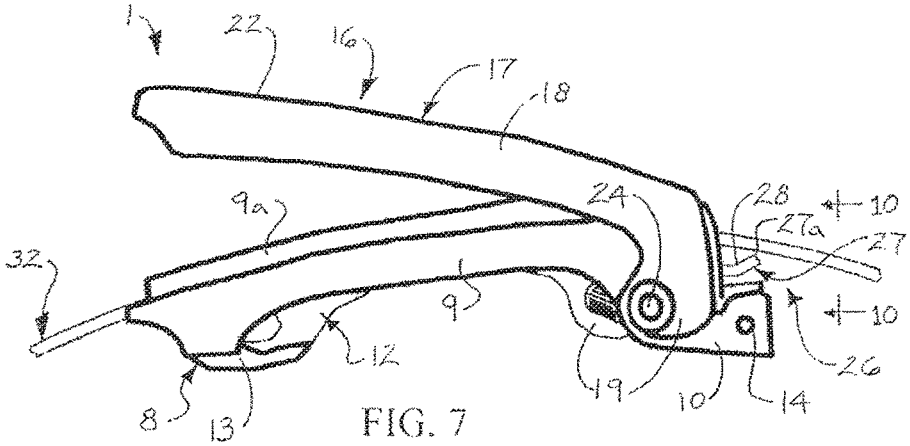
FIG. 7 is a side view of an illustrative embodiment of the belt adjustment system provided on a belt and deployed in the belt-releasing configuration, with the belt clamp removed from the belt adjustment system for clarity.

As further illustrated in FIGS. 9 and 10, a belt engaging assembly 26 may include a tab plate 30 which is provided on the belt engaging member 21. A generally elongated tooth-engaging tab 27 having a distal tab end 27*a* extends from the tab plate 30. As illustrated in FIGS. 6 and 7, the tooth-engaging tab 27 may have a tab bend 28, from which the angled distal tab end 27*a* extends forwardly. When the lever 16 is deployed in the belt-securing configuration illustrated in FIG. 9, the distal tab end 27*a* is disposed adjacent to the belt slot 23 and inserts in the belt groove 34 in the inside belt surface 33 of the belt 32 and engages one of the belt teeth 35, preventing movement of the belt 32 through the belt slot 23 and the belt space 12 of the buckle 8. Conversely, when the lever 16 is deployed in the belt-releasing configuration illustrated in FIG. 10, the distal tab end 27*a* of the tooth-engaging tab 27 clears the belt slot 23 and disengages the belt groove 34 and the belt teeth 35, facilitating free back-and-forth movement of the belt 32 through the belt slot 23 and the belt space 12.

A tab biasing mechanism such as a coiled tab spring 29, for example and without limitation, is sandwiched between the front connecting member 11 of the buckle 8 and the tab plate 30. Accordingly, the tab spring 29 normally biases the tooth-engaging tab 27 in the groove insert position illustrated in FIG. 9 and the lever 16 in the buckle-engaging configuration illustrated in FIGS. 3 and 6. Conversely, the lever 16 can be selectively pivoted against the bias which is imparted by the tab spring 29 to the buckle-disengaging configuration illustrated in FIGS. 4 and 7 such that the tooth-engaging tab 27 disengages the belt groove 34 and the belt teeth 35 in the belt 32. When the lever 16 is deployed in the buckle-engaging configuration, the spaced-apart side lever frame members 18 of the lever frame 17 may be nested on the outsides of the lever seat flanges 9*a*, respectively, on the buckle 8.

In exemplary use of the belt adjustment system 1, the attachment end 32*a* of the belt 32 is inserted in the belt clamp interior 2*a* of the belt clamp 2 with the clamp tooth tab 3 initially disposed in the open configuration illustrated in FIG. 2. The clamp tooth tab 3 is then pivoted to the closed position illustrated in FIG. 5 such that the clamp teeth 4 extend into the belt clamp interior 2*a* and engage and secure the attachment end 32*a* of the belt 32 in the belt clamp 2. The free adjustable end 32*b* and the remaining unsecured portion of the belt 32 may then be inserted through belt loops (not illustrated) in the pants of a user typically in the conventional manner.

Figure 3:
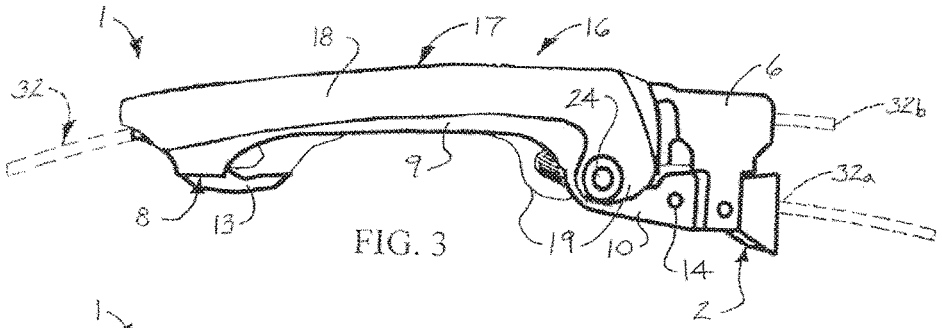
FIG. 3 is a side view of an illustrative embodiment of the belt adjustment system provided on a belt and deployed in a belt-securing configuration.

The tab spring 29 normally biases the tooth-engaging tab 27 in the tooth-engaging position illustrated in FIG. 9 and the lever 16 in the buckle-engaging position illustrated in FIGS. 3 and 6. Therefore, the lever 16 is manually pivoted to the buckle-disengaging position illustrated in FIGS. 4 and 7 such that the tooth-engaging tab 27 is deployed in the tooth-disengaging position illustrated in FIG. 10 to enable free passage of the belt 32 through the belt slot 23 and the belt space 12 of the belt adjustment system 1. Accordingly, the free adjustable end 32*b* of the belt 32 is inserted through the belt space 12 in the buckle 8 and then through the registering belt slot 23 (FIG. 9) and the belt stay 6, respectively, on the belt clamp 2. The lever 16 is then released such that the tab spring 29 returns the lever 16 to the buckle-engaging position such that the distal tab end 27*a* of the tooth-engaging tab 27 inserts into the belt groove 34 and engages one of the belt teeth 35 (FIG. 8) in the belt groove 34. Therefore, the tooth-engaging tab 27 prevents further movement of the belt 32 through the belt slot 23 and secures the belt 32 at a selected size or diameter around the waist of the user. The user can selectively subsequently pivot the lever 16 against the bias imparted by the tab spring 29 to the buckle-disengaging position to disengage the tooth-engaging tab 27 from the belt teeth 35 and the belt groove 34 and facilitate free movement of the adjustable end 32*b* of the belt 32 through the belt slot 23 until the belt 32 is tightened or loosened according to the preferences of the user. The lever 16 can subsequently again be released such that the tab spring 29 returns the tooth-engaging tab 27 to the tooth-engaging position in the belt groove 34 and the lever 16 to the buckle-engaging position to secure the belt 32 at the selected size or diameter.

It will be appreciated by those skilled in the art that the belt adjustment system 1 allows a user to actuate the lever 16 with one hand to selectively tighten or loosen the belt 32. The belt adjustment system 1 can be selectively removed from the belt 32 by disengaging the clamp teeth 4 on the clamp tooth tab 3 from the attachment end 32*a* of the belt 32, pivoting the lever 16 to the belt-releasing position and sliding the adjustable end 32*b* of the belt 32 from the belt slot 23 (FIGS. 9 and 10) and the belt space 12 (FIG. 2).

Figure 13:
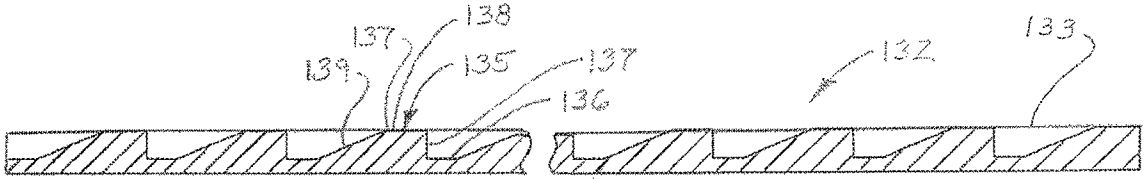
FIG. 13 is a longitudinal sectional view, taken along section lines 13-13 in FIG. 12.
Figure 14:
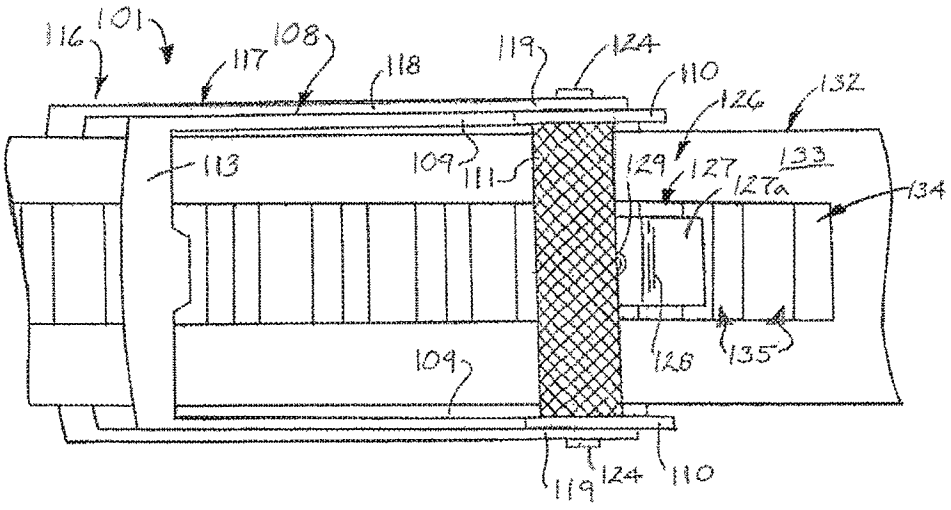
FIG. 14 is a bottom view of an illustrative embodiment of the belt adjustment system, provided on the belt illustrated in FIGS. 12 and 13.
Figure 14A:
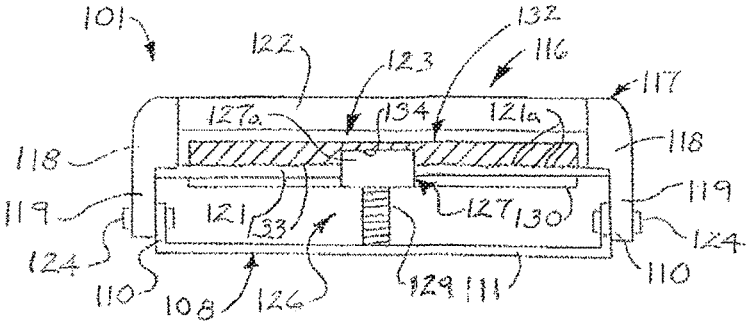
FIG. 14A is a front view of an illustrative embodiment of the belt adjustment system, provided on the belt illustrated in FIGS. 12 and 13 and deployed in the belt-securing configuration.
Figure 14B:
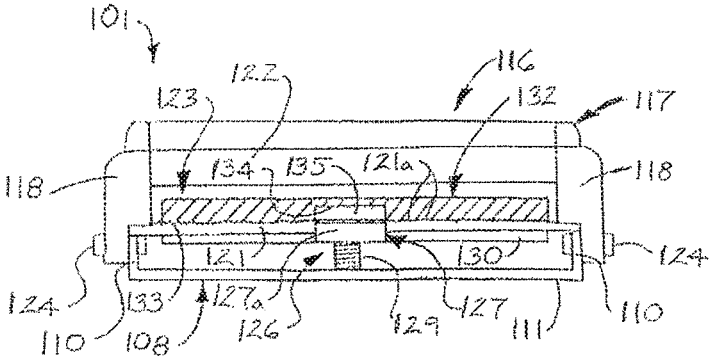
FIG. 14B is a front view of an illustrative embodiment of the belt adjustment system provided on the belt illustrated in FIGS. 12 and 13 and deployed in the belt-releasing configuration.
Figure 14C:
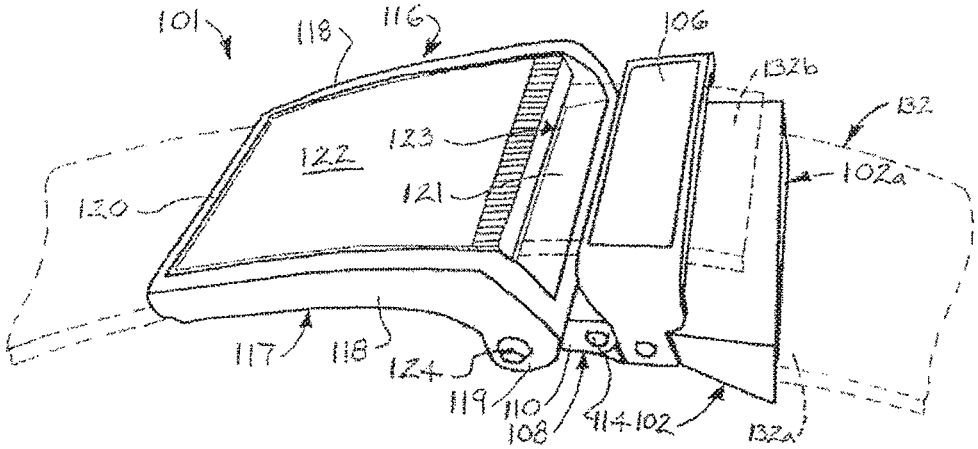
FIG. 14C is a top perspective view of an illustrative embodiment of the belt adjustment system provided on the belt illustrated in FIGS. 12 and 13 (illustrated in phantom)
Figure 14D:
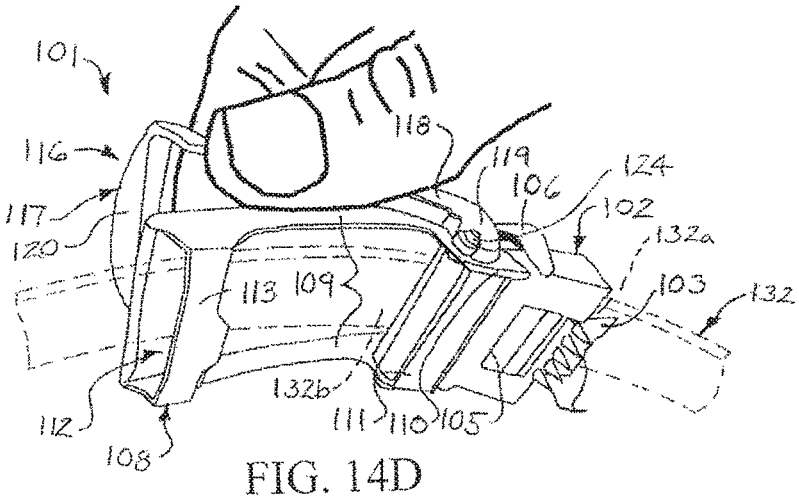
FIG. 14D is a bottom perspective view of an illustrative embodiment of the belt adjustment system provided on the belt illustrated in FIGS. 12 and 13 (illustrated in phantom)

Referring next to FIGS. 12-14D of the drawings, an alternative belt which is suitable for implementation of an illustrative embodiment of the belt adjustment system 101 (FIG. 14) is generally indicated by reference numeral 132. The belt adjustment assembly 101 may have a design which is the same as or similar to that of the assembly 1 that was heretofore described with respect to FIGS. 1-11. Accordingly, in the belt adjustment assembly 101, elements which are analogous to the respective elements of the assembly 1 are designated by the same numeral in the 100 series in FIGS. 12-14. A belt 132 which is suitable for implementation of the belt adjustment system 101 includes an inside belt surface 133. A generally elongated, rectangular belt groove 134 is provided in the inside belt surface 133. Multiple belt teeth 135 are provided in the belt groove 134. The belt teeth 135 may span the width of the belt groove 134 in adjacent, spaced-apart relationship to each other. As illustrated in FIG. 13, in some embodiments, belt adjustment slots 136 may separate adjacent belt teeth 135 from each other in the belt groove 134. Each belt tooth 135 may include a generally flat or planar tab stop surface 137 which is generally perpendicular to a plane of the inside belt surface 133, a generally flat or planar tooth outer surface 138 which extends forwardly from the tab stop surface 137 and is generally parallel to the plane of the inside belt surface 133 and a sloped or beveled tab slide surface 139 which extends forwardly from the tooth outer surface 138 and is opposite the tab stop surface 137 and sloped relative to the inside belt surface 133.

Exemplary use of the belt adjustment system 101 may be as was heretofore described with respect to the belt adjustment system 1. The tab spring 129 normally biases the tooth-engaging tab 127 in the tooth-engaging position and the lever 116 in the buckle-engaging position (FIGS. 3 and 6). Therefore, the lever 116 is manually pivoted to the buckle-disengaging position (FIGS. 4 and 7) such that the tooth-engaging tab 127 is deployed in the tooth-disengaging position (FIG. 10) to enable free passage of the belt 132 through the belt slot 123 of the belt adjustment system 101. The lever 116 is released such that the tab spring 129 returns the lever 116 to the buckle-engaging position and the distal tab end 127*a* of the tooth-engaging tab 127 inserts into the belt groove 134 and engages the tab stop surface 137 (FIG. 13) of one of the belt teeth 135 in the belt groove 134.

Therefore, the tooth-engaging tab 127 prevents further movement of the belt 132 and secures the belt 132 at a selected size or diameter around the waist of the user. The user can selectively pull the belt 132 through the belt slot 123 of the belt adjustment system 101 to tighten the belt 132 around the waist of the user without pivoting the lever 116 such that the tooth-engaging tab 127 slides along the tab slide surfaces 139 of the respective belt teeth 135 and catches on the tab stop surface 137 of one of the belt teeth 135 to stop the belt 132 at the selected diameter. Alternatively, the user can selectively pivot the lever 116 against the bias imparted by the tab spring 129 to the buckle-disengaging position to disengage the tooth-engaging tab 127 from the belt teeth 135 and the belt groove 134 and facilitate free movement of the adjustable end 132*b* of the belt 132 through the belt slot 123 until the belt 132 is tightened or loosened according to the preferences of the user. The lever 116 can subsequently again be released such that the tab spring 129 returns the tooth-engaging tab 127 to the tooth-engaging position in the belt groove 134 and the lever 116 to the buckle-engaging position to secure the belt 132 at the selected size or diameter.

Figure 15:
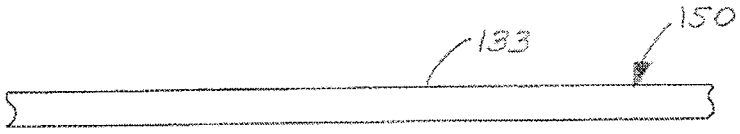
FIGS. 15-17 illustrate sequential fabrication of a belt according to an illustrative embodiment of a belt fabrication method.

Referring next to FIGS. 15-19 of the drawings, sequential fabrication of a belt 132 according to an illustrative embodiment of a belt fabrication method is illustrated. In FIG. 15, a belt blank 150 having a selected length is provided. The belt blank 150 may be a webbing strap material of polyester, nylon or other suitable material. The belt blank 150 has an inside belt surface 133.

Figure 16:
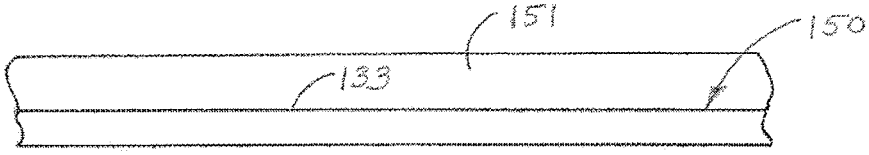

In FIG. 16, a belt coating layer 151 is provided on the inside belt surface 133 of the belt blank 150. The belt coating layer 151 may be rubber, plastic or other moldable or deformable material. The belt coating layer 151 may be applied to the inside belt surface 133 by immersion or other coating or deposition processes known by those skilled in the art.

Figure 17:
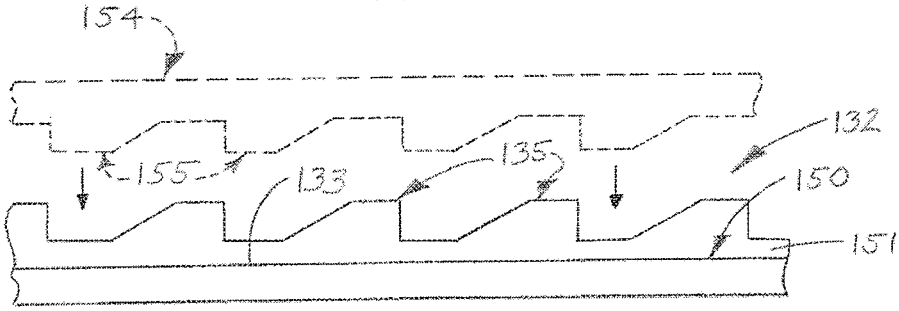
Figure 18:
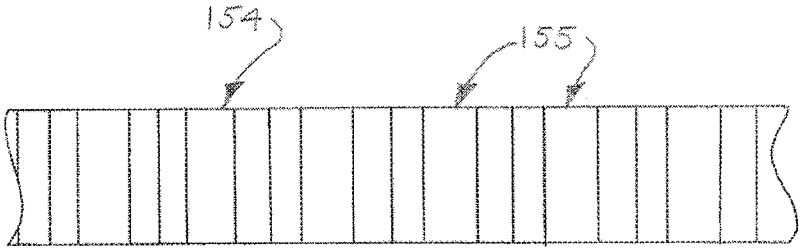
FIG. 18 is an inside surface view of an exemplary die which is suitable for fabrication of the belt illustrated in FIGS. 12 and 13 according to an illustrative embodiment of a belt fabrication method.
Figure 19:
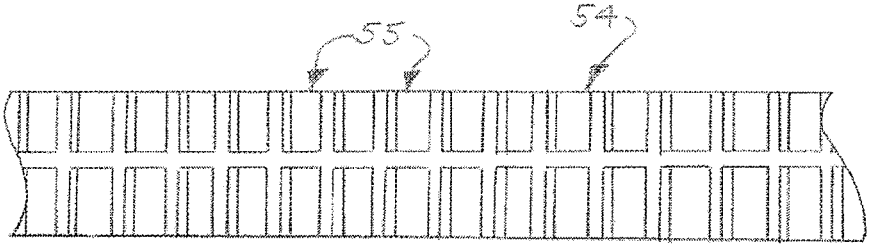
FIG. 19 is an inside surface view of an exemplary die which is suitable for fabrication of the belt illustrated in FIG. 11 according to an illustrative embodiment of a belt fabrication method.

In FIG. 17, a belt die 154 is applied to the belt coating layer 151 to form the belt groove 134 and the belt teeth 135. The belt die 154 has multiple die teeth 155 which are complementary mirror-images of the belt teeth 135 which are formed in the belt coating layer 151. An inside surface view of an exemplary belt die 154 which is suitable for the purpose of forming the belt groove 134 and the belt teeth 135 in the belt 132 is illustrated in FIG. 18. An inside surface view of an exemplary belt die 55 which is suitable for the purpose of forming the belt groove 34 and the belt teeth 35 in the belt 32 which was heretofore described with respect to FIGS. 1-11 is illustrated in FIG. 18. Post-processing steps may include curing of the belt coating layer 151 according to the knowledge of those skilled in the art.

In some embodiments of the method, the structural webbing and the plastic belt coating layer 151 and the imprinting of the belt groove 134 and the belt teeth 135 in the belt coating layer 151 may be formed in a continuous process. Therefore, lengths of the belt 132 of greater than 100 feet and up to 1000 feet may be fabricated in a continuous operation. Thereafter, the individual belts 132 may be cut to the exact length, as needed, and shorter-length belts may be cut from a continuous roll of integrated belt material. The fabrication process may be significantly more economical than conventional processes used to fabricate slotted and ratchet-operable or slide belts. The method may eliminate the need to sew a separate plastic slotted strip into the inside belt surface 133 of the belt 132.

Figure 20:
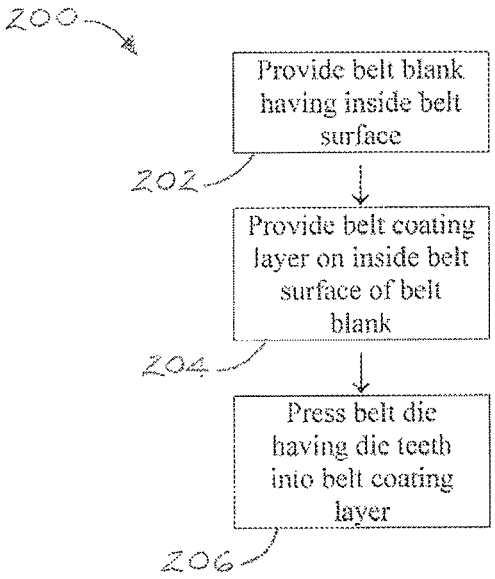
FIG. 20 is a flow diagram of an illustrative embodiment of a belt fabrication method.

Referring next to FIG. 20 of the drawings, a flow diagram 200 of an illustrative embodiment of a belt fabrication method is illustrated. In block 202, a belt blank having an inside belt surface is provided. In some embodiments, the belt blank may be a webbing strap material of polyester, nylon or other suitable material. In block 204, a belt coating layer is provided on the inside belt surface of the belt blank. The belt coating layer may be rubber, plastic or other moldable or deformable material. In block 206, a belt die having die teeth is pressed into the belt coating layer to form the belt groove and the belt teeth in the belt coating layer. In some embodiments, the belt groove and the belt teeth may be formed in the belt coating layer in a continuous process.

With reference to FIGS. 21-29B, another embodiment of a belt adjustment system 301 is illustrated. The belt adjustment system 301 may be coupled with a belt 132, as described above in FIGS. 12, 13, and 14. The belt 132 may have an inside belt surface 133 which faces the waist of the user and an elongated belt groove 134 extends along at least a portion of the inside belt surface 133. Multiple, spaced-apart belt teeth 135, which may be plastic or other material, are provided in the belt groove 134. The belt adjustment system 301 engages the belt teeth 135 in the belt groove 134 to secure the belt 132 at a selected diameter around the waist of the user. Other belts, such as the belt 32 illustrated in FIGS. 8 and 11, can be used with the belt adjustment system 301.

As illustrated in FIGS. 21-29B, the belt adjustment system 301 includes a body 301*a* that includes a belt clamp portion 302 and a buckle portion. In some embodiments, the body 301*a* can manufactured as a single unit. In some embodiments, the belt adjustment system 301 can be manufactured from a polymer mixture, such as glass filled nylon. In some embodiments, the belt adjustment system can be manufactured from a metal, such as stainless steel, aluminum, or other materials. In some embodiments, the body 301*a* can be assembled from multiple sections coupled together by fasteners, such as the embodiment of the belt adjustment system 1 illustrated in FIG. 1.

Figure 27:
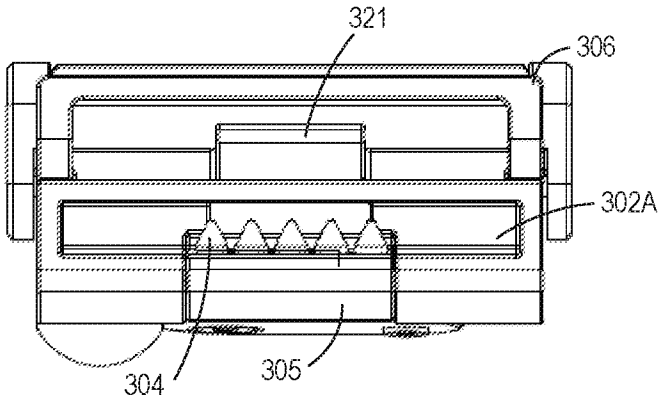
FIG. 27 is a back end view of an illustrative embodiment of the belt adjustment system.
Figure 26:
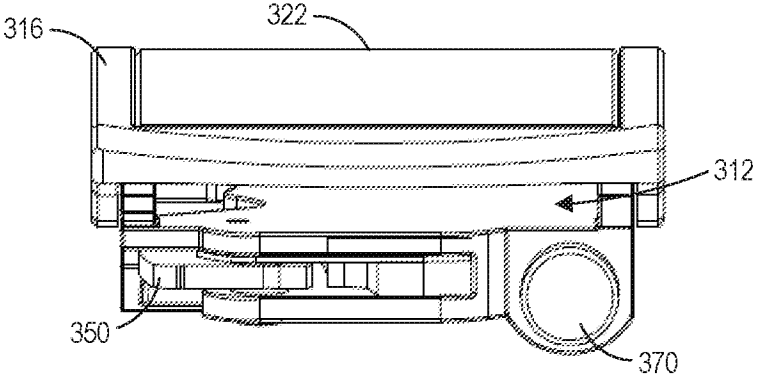
FIG. 26 is a front end view of an illustrative embodiment of the belt adjustment system.

In some embodiments, the belt clamp portion 302 may have a belt clamp interior 302*a* (FIG. 27). A tab opening 305 (FIG. 21) in the belt clamp 2 may communicate with the clamp interior 302*a*. A belt tooth tab 303 may be pivotally attached to the belt clamp portion 302 adjacent to the tab opening 305. Multiple belt teeth 304 may extend from the belt tooth tab 303. The belt tooth tab 303 may be positional between an open, belt-releasing configuration, similar to the position of the belt tooth tab 3 illustrated in FIG. 2, in which the belt tooth tab 303 is unseated from the tab opening 305 and the belt teeth 304 are disposed outside the belt clamp interior 302*a*, and a closed, belt-engaging configuration (FIG. 27) in which the belt tooth tab 303 is seated in the tab opening 305 and the belt teeth 304 extend into the belt clamp interior 302*a*. The belt teeth 304 are adapted to engage and secure an attachment end 132*a* of the belt 132 which is inserted in the belt clamp interior 302*a* of the belt clamp portion 302 to attach the belt adjustment system 301 to the belt 132. In other embodiments, the belt clamp portion 302 of the belt adjustment system may include any design which facilitates attachment of the belt adjustment system 301 to the attachment end 132*a* of the belt 132 according to the knowledge of those skilled in the art.

A belt stay 306 may be positioned on a top side of body 301*a*. The belt stay 306 can form an opening that accommodates the free adjustable end 132*b* of the belt 132. The belt stay 306 can function as a bottle opener. For example, a bottle cap can be positioned between the top side of the body 301*a* and the belt stay 306. The edge of the bottle cap would rest on the edge of the belt stay 306 to pry the bottle cap off.

The belt adjustment system 301 includes a buckle portion 307. In some embodiments, the buckle portion 307 can be a separate piece, and can connected to the belt clamp portion 302, such as in the embodiment illustrated in FIGS. 1-5. The buckle portion 307 includes a buckle frame portion 308 and a tool housing portion 340.

Figure 28:
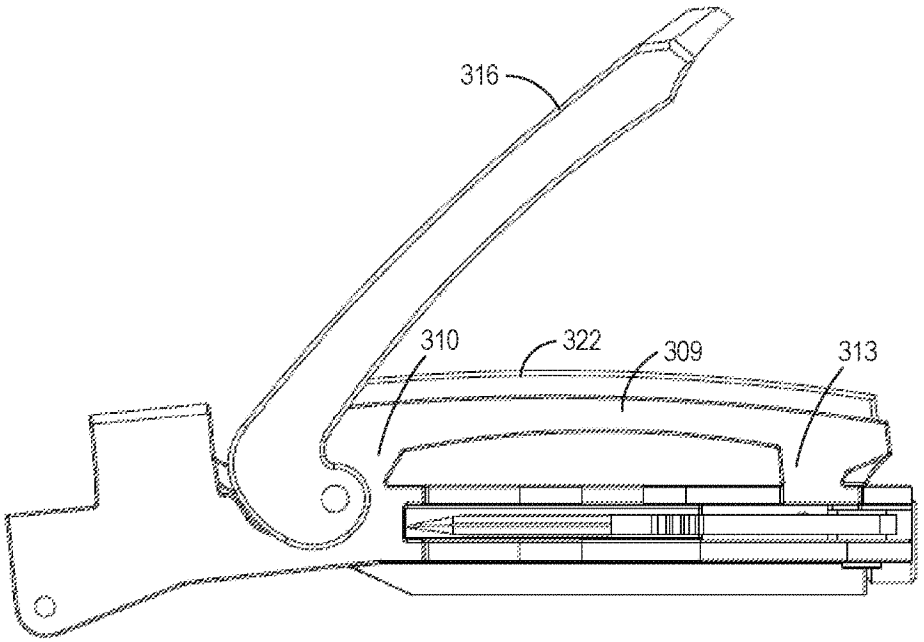
FIG. 28 is a right side view of an illustrative embodiment of the belt adjustment system with the lever in an actuated position.

The buckle frame portion 308 may include a buckle plate 322, side buckle members 309, rear buckle connecting members 310, and front buckle connecting members 313. The elongated, spaced-apart side buckle members 309 extend from the buckle plate 322. In some embodiments, the buckle plate 322 may be offset from an outer edge of the side buckle members 309 (as illustrated in FIG. 28). Rear buckle connecting members 310 may extend between the side buckle members 309 and the tool housing portion 340. The rear buckle connecting members 310 can be in a generally spaced-apart relationship to each other, in some embodiments the rear buckle connecting members 310 may be substantially parallel. Front buckle connecting members 313 may extend between the side buckle members 309 and the tool housing portion 340. The front buckle connecting members 313 can be in a generally spaced-apart relationship to each other, in some embodiments the front buckle connecting members 313 may be substantially parallel. The side buckle members 309, the front buckle connecting members 313, the rear buckle connecting members 313, and the inner wall 342 together form a belt space 312 which accommodates the adjustment end 132*b* of the belt 132.

Figure 21:
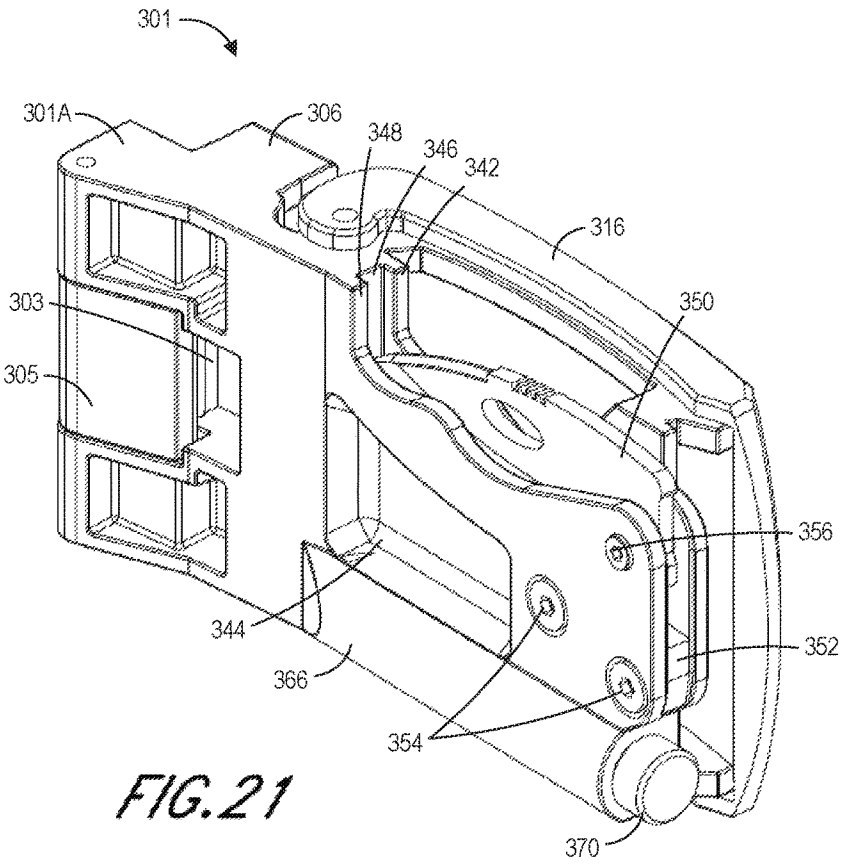
FIG. 21 is a bottom perspective view of an illustrative embodiment of the belt adjustment system.

A tool housing portion 340 is positioned under the buckle frame portion 308. The belt space 312 is between the buckle frame portion 308 and the tool housing portion 340. When in use by the user the tool housing portion 340 is positioned between wearer and the belt space. The tool housing portion 340 includes an inner wall 342 that extends at least a portion of the width of the buckle portion 308. In some embodiments, the inner wall 342 may be contoured and have portions of the wall removed, such as cut out 344. The cutout may be sized and shaped to accommodate components of the tool housing. The tool housing portion 340 can include an outer wall 346. In some embodiments, the outer wall 346 can be generally parallel to the inner wall 342. The outer wall 346 can extend at least a portion of the width of the buckle portion 307. The inner wall 342 and the outer wall 346 cooperate to form a tool slot 348. In some embodiments, the inner wall 342 and outer wall 346 are formed as a single component as illustrated in FIG. 21. In some embodiments, the inner wall 342 and outer wall 346 are separate components that are coupled together. For example, the inner wall 342 may be formed as part of the buckle portion 308 during manufacturing and the outer wall 346 may be coupled to the body 301*a* during assembly of the belt adjustment system 301. In such embodiments, the outer wall 346 may be coupled to the body 301*a* with fasteners, welding, or other attachment mechanism known to those skilled in the art. One or both of walls 342 and 346 can be integrally formed as a single component with the body 301*a* and/or the buckle frame portion 308.

The tool slot 348 formed by the inner wall 342 and outer wall 344 is configured to accommodate a tool 350 coupled to the body 301*a*. In some embodiments, the tool 350 can be pivotally coupled with a pivoting fastener 356. In some embodiments, the tool 350 may be linearly coupled to the body 301*a*. A spacer 352 can be positioned between the inner wall 342 and outer wall 346. The spacer 352 can be coupled between the outer wall 346 and inner wall 342 by one or more fasteners 354. In some embodiments, the spacer 352 can be integrally formed with one or both walls 342 and 346. The spacer 352 can be positioned between the inner wall 342 and the outer wall 346 to increase the structural integrity of the body 301*a*. For example, the spacer 352 can help prevent deflection of the outer wall 346 during use of the tool 350. The spacer 352 can be positioned and configured to function as a positioning mechanism for limiting movement of the tool 350 between the closed and/or open positions. For example, the spacer 352 can operate as a rotational stop for positioning the tool 350 in an open position. The outer wall 346 and inner wall 346 can have contoured top edges that are configured to allow for a user to rotate and manipulate the tool 350 within the slot 348. A sharp end and/or edge of the tool 350 (such as blade edge 358) can be positioned within slot 348 such that the sharp edge of the tool is not exposed and does not extend out of the slot 348 when the tool 350 is in the closed position. In some embodiments, the tool housing portion 340 may include a bottle opener, such as the belt stay 306, or the bottle opener 13*a* illustrated in FIG. 2. In some embodiments, a bottle opener may extend from the outer wall 346 into the cavity 344 or out from a distal end of the outer wall.

Figure 29A:
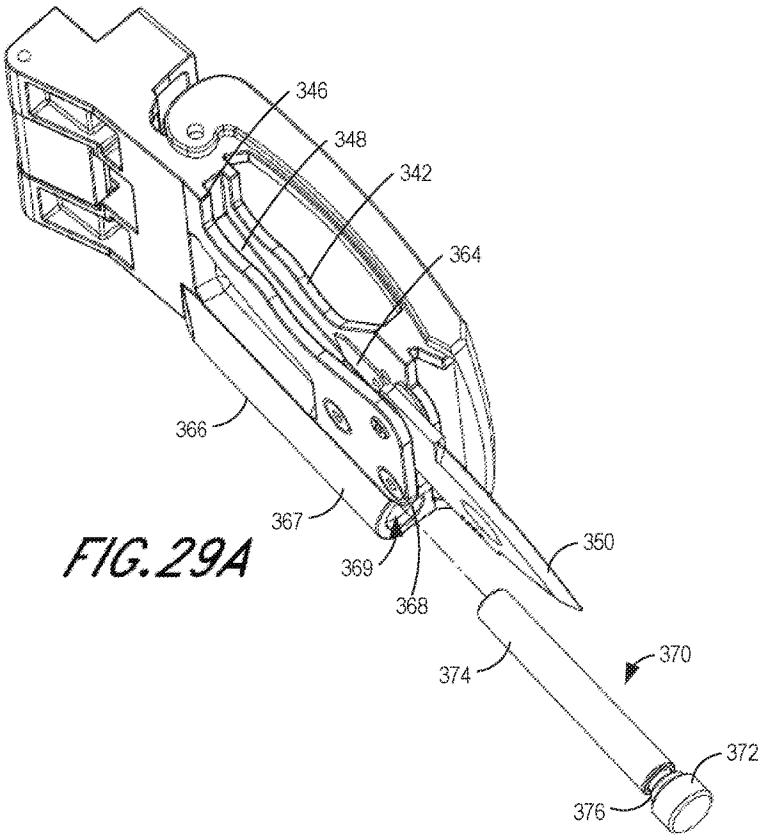
FIGS. 29A and 29B are views of an illustrative embodiment of the belt adjustment system with the tool in an open position and the cavity tool removed from the cavity.
Figure 29B:
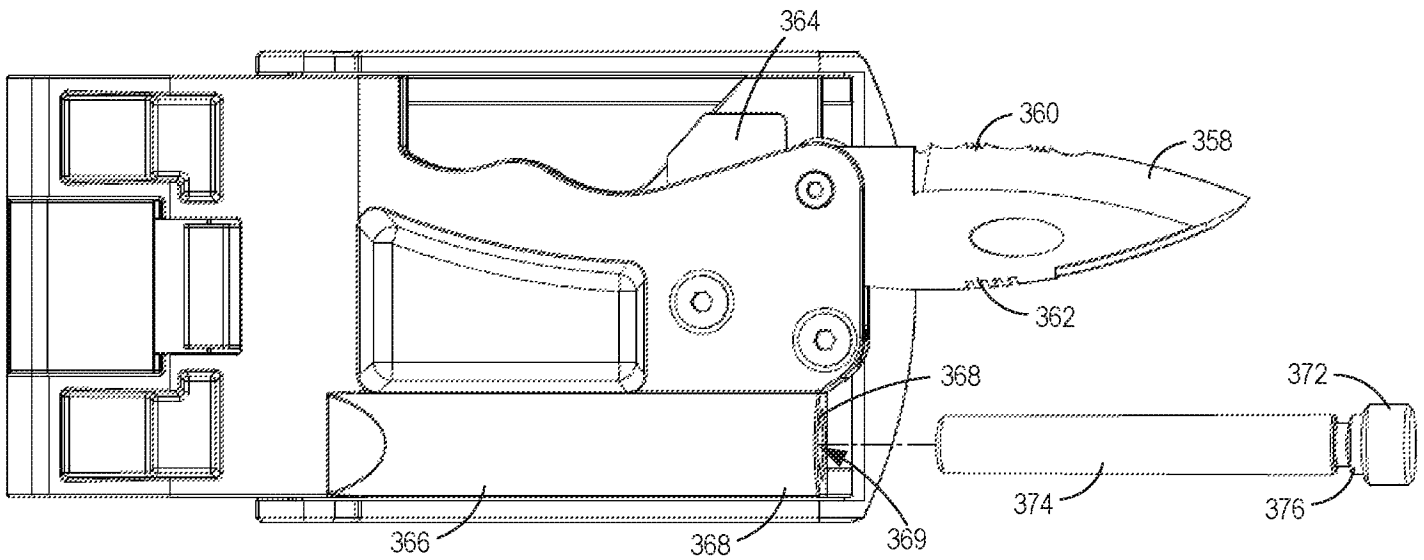

The tool 350 can be sized and configured to be positioned within the slot 348 and coupled (e.g., pivotally) to the tool housing portion 340 between the inner wall 342 and the outer wall 346. The tool 350 can be manipulated by a user between a closed position (FIG. 21) and an open position (FIGS. 29A and 29B). The tool 350 can be configured to be secured in the open position by a locking mechanism 364, such a biased plate (illustrated) or a spring, that functions to lock the tool in the open position. The biasing mechanism 364, also referred to as a locking mechanism, can help to prevent the tool 350 from moving to the closed position unintentionally when in use by the user. The plate biases to the locking position so that it moves behind the tool in the open position, thereby preventing the tool from closing. The biasing mechanism 364 and/or the tool 350 can be manipulated by the user in order to move the tool 350 from the open position to the closed position, such as by pressing the locking mechanism against the inner wall 342. The illustrated tool 350 includes a number of features, such as a blade edge 358, a serrated portion 360, notches 362, and a hole 363. The hole 363 may be provided to facilitate grasping and manipulating the tool 350 by the user. In some embodiments, the hole 363 may be replaced with an indent or other feature to provide similar functionality. The tool 350 is shown for illustrative purposes and the belt adjustment system 301 is not limited to the illustrated tool. Rather the tool 350 can be any type of tool that can be configured to be coupled to the belt adjustment system 301. In some embodiments, the tool 350 can incorporate functional elements, such as a knife blade, a bottle opener a nail pry, a scraper, a saw blade, a screwdriver (phillips, flat head, socket), can opener, and the like. The tool 350 can incorporate a single functional element, or incorporate any number of functional elements. In some embodiments, the tool 350 is coupled to the tool portion and cannot be easily removed without additional tools. In some embodiments, the tool 350 may be decoupled from the tool portion without the use of tools. In such embodiments, the tool 350 may be usable without being coupled to the belt adjustment system 301. In some embodiments, the tool 350 is swappable and can be decoupled and replaced with a variety of tools 350. In some embodiments, more than one tool 350 may be positioned within the slot 348. For example, a plurality of tools 350 may be positioned within the slot 348, and each tool can be individually manipulated and moved between open and closed positions.

The tool housing portion 340 can also include a tool cavity portion 366. The tool cavity portion can be positioned below the outer wall 346. The tool cavity portion 366 can be configured to house a cavity tool 370 within a cavity 369 (e.g., formed within the body 301*a*). In some embodiments, the tool cavity is positioned between the inner wall 342 and the outer wall 346. The tool cavity portion 366 comprises an inner cavity wall 368 and an outer cavity wall 367. The inner cavity wall 368 forms a cavity 369. The inner cavity wall 368 can be sized and configured to engage a cavity tool 370. In this embodiment, the tool cavity portion 366 includes a cylindrical, or substantially cylindrical, cavity 369. In some embodiments, the cavity 369 can be a different shape and size. For example, the outer cavity 367 wall may be flush with the outer wall 346, or the outer cavity wall 367 may be the same as the outer wall 346. The cavity 369 extends a defined length within the body 301*a*. The inner cavity wall 368 can be rectangular, oval, or another shape in order to accommodate the cavity tool 370. The cavity tool 370 can include a handle portion 372 and a body portion 374. The handle portion 372 is sized and configured to be positioned exterior to the cavity 369. The body portion 374 is sized and configured to be positioned within the cavity 366. The cavity tool 370 can include a seal 376 to help secure the cavity tool 370 within the cavity 366. The seal 376 can help provide an environment that is air and/or water tight. For example, the seal 376 may be an o-ring that is deformed on insertion to seal against the inner wall 368 and prevent water from entering the cavity. In an alternative embodiment, the cavity 369 can include a threaded engagement portion, such as on the outer cavity wall 367 or on the inner cavity wall 368. The threaded engagement can be used to securely mount the cavity tool 370 within the cavity 369.

In one embodiment, the cavity tool 370 can be a firestarter rod, such as a cerium mischmetal rod or a ferrocerium rod, for use in generating sparks to start a fire. In such an embodiment, a portion of the body 301*a* can be used as a striker for the firestarter rod to generate sparks. In some embodiments, the cavity tool 370 can be another type of tool, such as a flashlight. In some embodiments, the tool may be permanently secured within the body 301*a*. For example, a flashlight may be permanently secured in place of the illustrated cavity tool and a switch or other manipulatable element for controlling operation of the flashlight. The tool cavity portion 366 can house any number of functional tools or elements that are configured to be positioned the cavity 369. In some embodiments, the cavity 369 may be configured to have a specific mechanical shape and size that corresponds to a matching mechanical configuration on multiple tools, such that a range of tools can be used with the same cavity configuration. In some embodiments, the belt adjustment system 301 may include a plurality of tool cavities 366. For example, two or more cavities may be positioned with the body 301*a*.

Figure 22:
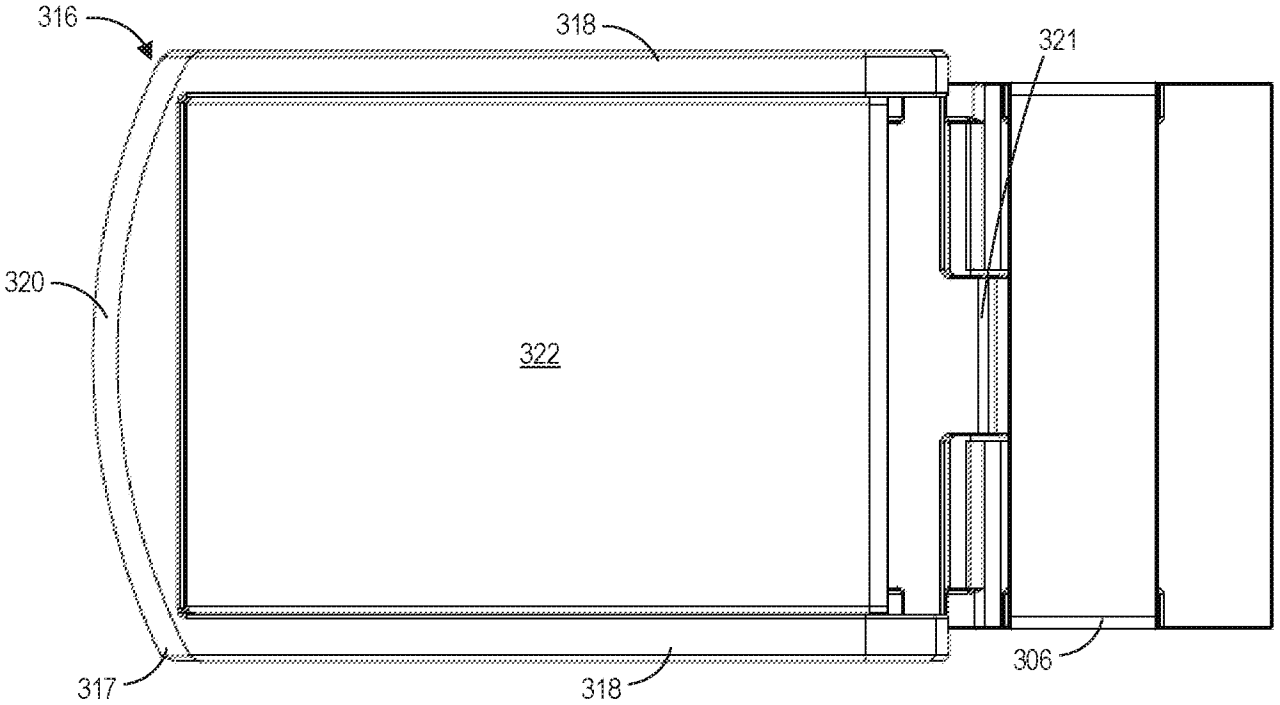
FIG. 22 is a top view of an illustrative embodiment of the belt adjustment system.
Figure 23:
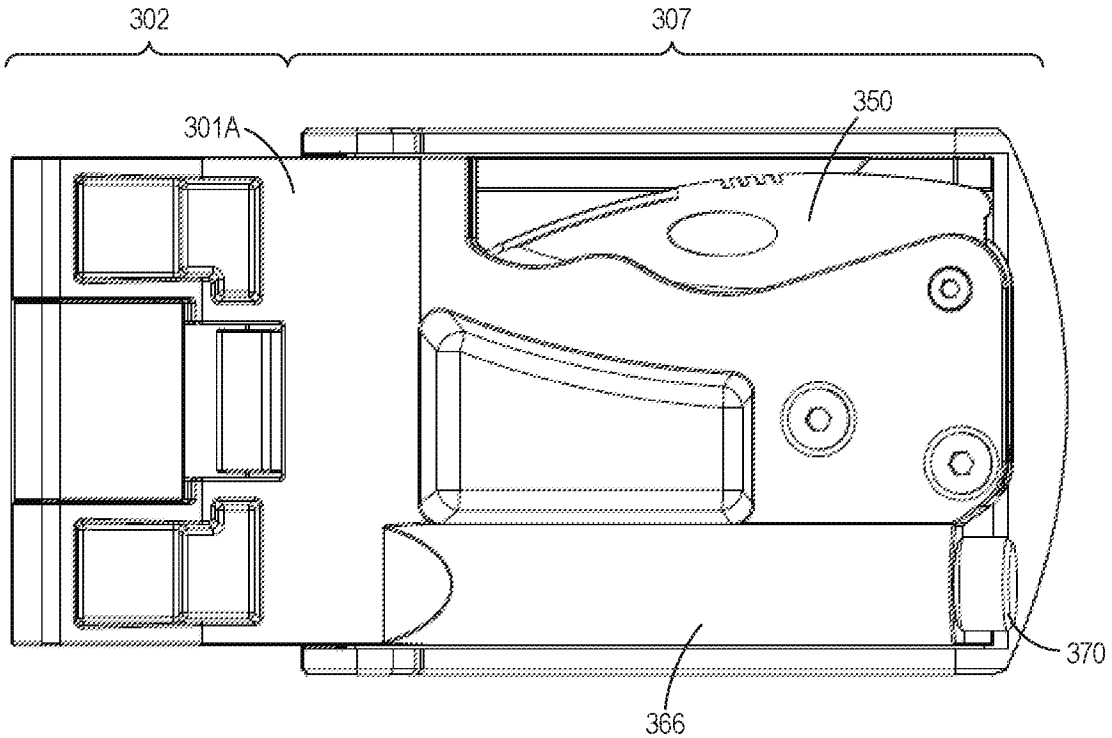
FIG. 23 is a bottom view of an illustrative embodiment of the belt adjustment system.
Figure 24:
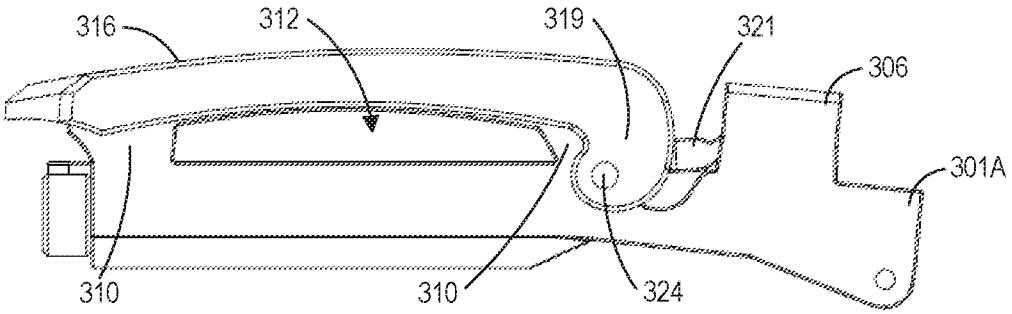
FIG. 24 is a left side view of an illustrative embodiment of the belt adjustment system.
Figure 25:
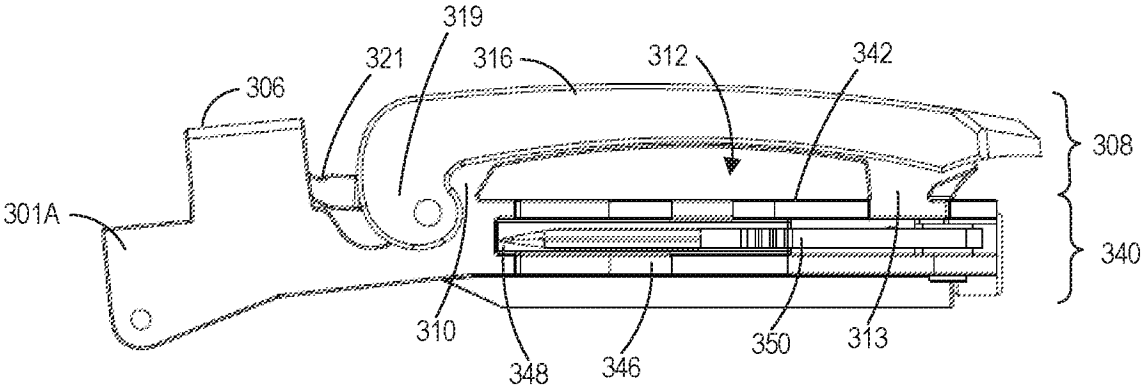
FIG. 25 is a right side view of an illustrative embodiment of the belt adjustment system.

A lever 316 is pivotally attached to the buckle portion 308 of the body 301*a*. The lever 316 may include a lever frame 317 which may be generally elongated and rectangular. The lever frame 317 may have a pair of generally elongated, parallel, spaced-apart side lever frame members 318 which terminate in a pair of lever frame flanges 319. The lever frame flanges 319 may be pivotally attached to the rear buckle connecting members 310, respectively, of the buckle 308 via pivot pins 324. A connecting frame member 320 may extend between the spaced-apart rear ends of the side lever frame members 318. As illustrated in FIGS. 22 and 25, a belt engaging member 321 extends between the spaced-apart lever frame flanges 319. As the lever 316 is pivoted between a belt-securing configuration illustrated, for example, in FIGS. 3, 9, and 24, and a belt-releasing configuration illustrated, for example, in FIGS. 4, 7, 10, 14B, 14D, and 28, the belt engaging member 321 pivots along with the lever 316, as described herein. A belt slot 312 may be formed by and between the side lever frame members 318, the belt-engaging member 321, and the buckle plate 322. The belt slot 312 can be sized and configured to accommodate the belt 132 in use with the belt adjustment system 301. In some embodiments, a plurality of serrations may be provided on the belt engaging member 321 in facing relationship to the belt slot 312, which can help engage the belt groove 134 and the belt teeth 135.

The belt adjustment system 301 can be configured to have a high tensile strength. In some embodiments, when the belt adjustment system 301 is coupled to a belt strap, such as belt strap 32 or 132, the tensile strength can be 2,000 pounds or more. In some embodiments, the tensile strength can be between 1,000 pounds and 2,000 pounds, or less than 1,000 pounds. In some embodiments, tensile strength can be about 500 pounds, about 750 pounds, about 1000 pounds, about 1250 pounds, about 1500 pounds, about 1750 pounds, about 2000 pounds, about 2250 pounds, about 2500 pounds, about 2750 pounds, about 3000 pounds, or any values there between, and all ranges bounded by these values.

Figure 30:
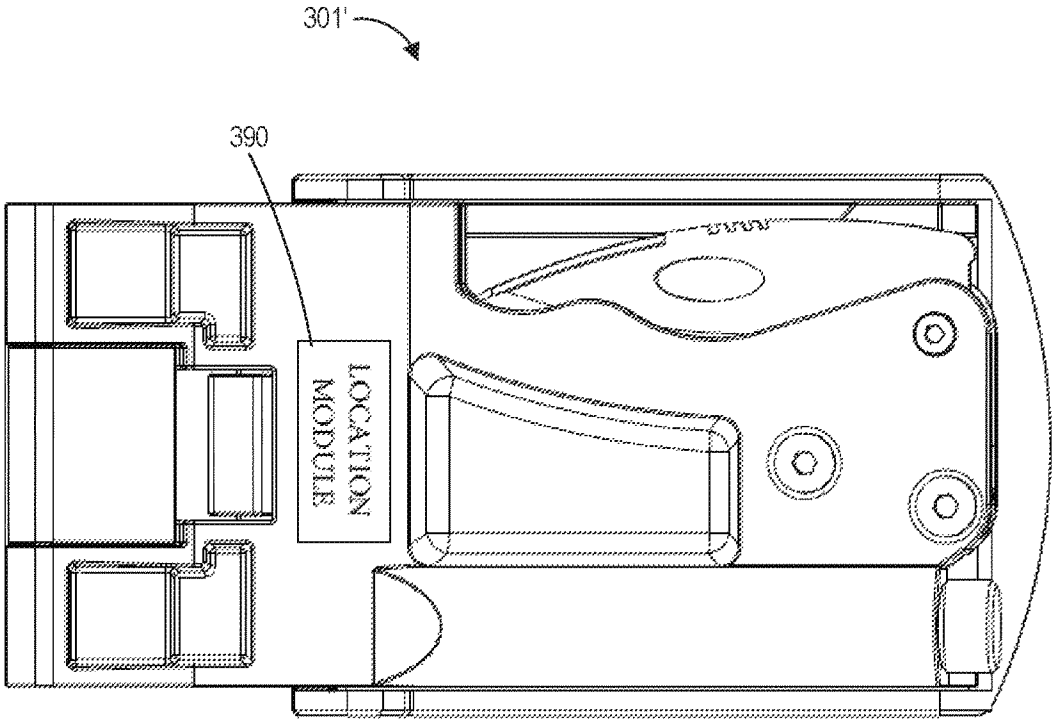
FIG. 30 is a bottom view of an illustrative embodiment of the belt adjustment system with a location module.

FIG. 30 illustrates another embodiment of the belt adjustment system 301' with an integrated location module 390. The location module 390 can use a Global Positioning System (GPS) component. The location module 390 can include Global Positioning System (GPS) componentry, a power supply, and operational circuitry housed within the body 301*a*. The power supply can be a battery or a plurality of batteries housed within the body 301*a*. In some embodiments, the power supply may be a rechargeable power supply such as a lithium-ion battery. In some embodiments, the power supply may be removable. In some embodiments, the belt adjustment system 301' may include a port for recharging the power supply. The location module 390 can have user interface components such as button or other indicators for controlling the operation of the location module. For example, the location module 390 may include one or more light-emitting diodes (LED) for displaying a status of the location module. The LEDs may be configured to display different color and or display patterns based on the operational status of the location module 390. In one embodiment, the location module may include active, sleep, and standby modes of operation. The location module 390 can use satellite-based tracking technology to determine the location of the belt adjustment system 301' when activated. The location module 390 can be configured to have low power consumption and reliability by providing transmissions at regular intervals during operation. In some embodiments, the location module 390 can be used globally. In some embodiments, the location module 390 can last multiple months without replacing or recharging the power supply. In some embodiments, the location of the device may be accessible on a web-based interface. For example, a user may log into a web-based interface and can track the current location of the location module 390. In some embodiments, the belt adjustment system 301' can provide a waterproof housing for the location module 390. The location module 390 can provide emergency tracking of a user.

Figure 31:
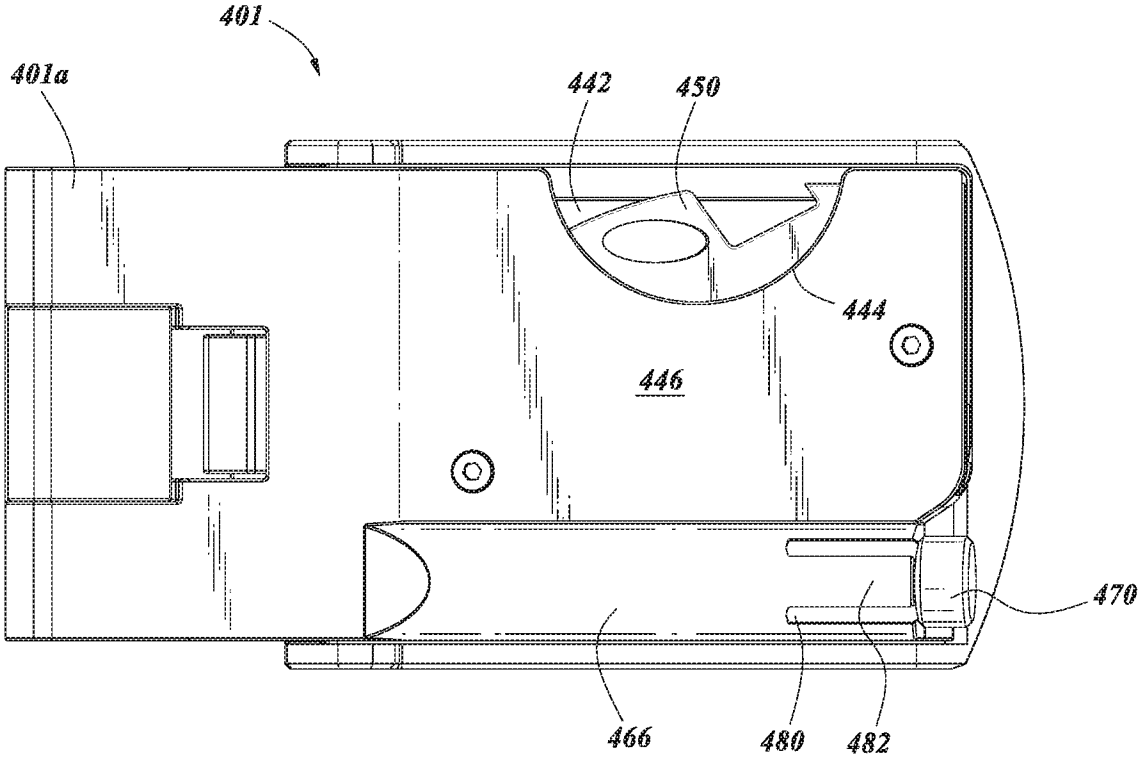
FIG. 31 is a bottom view of another illustrative embodiment of a belt adjustment system.
Figure 32:
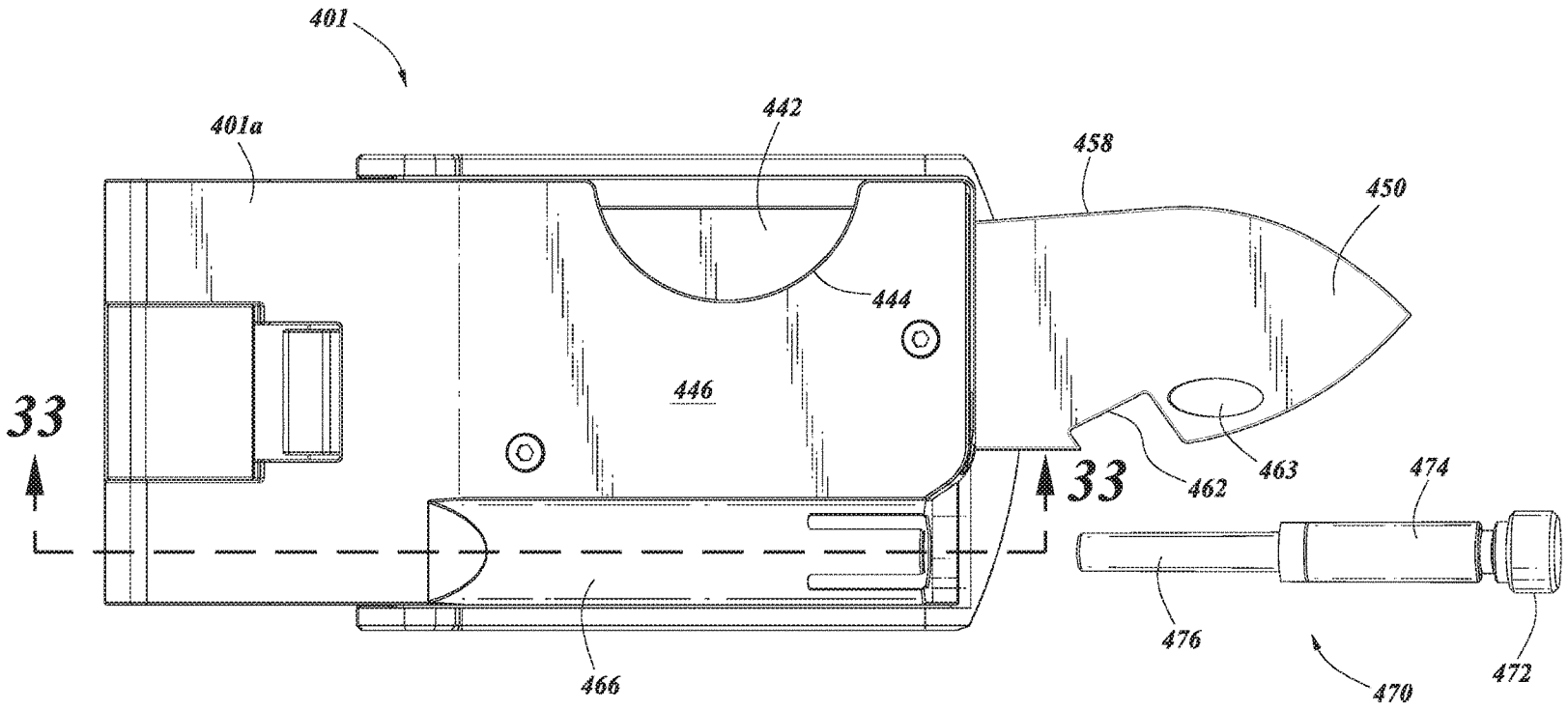
FIG. 32 is a view of an illustrative embodiment of the belt adjustment system of FIG. 31 with the tool in an open position and the cavity tool removed from the cavity.
Figure 33:
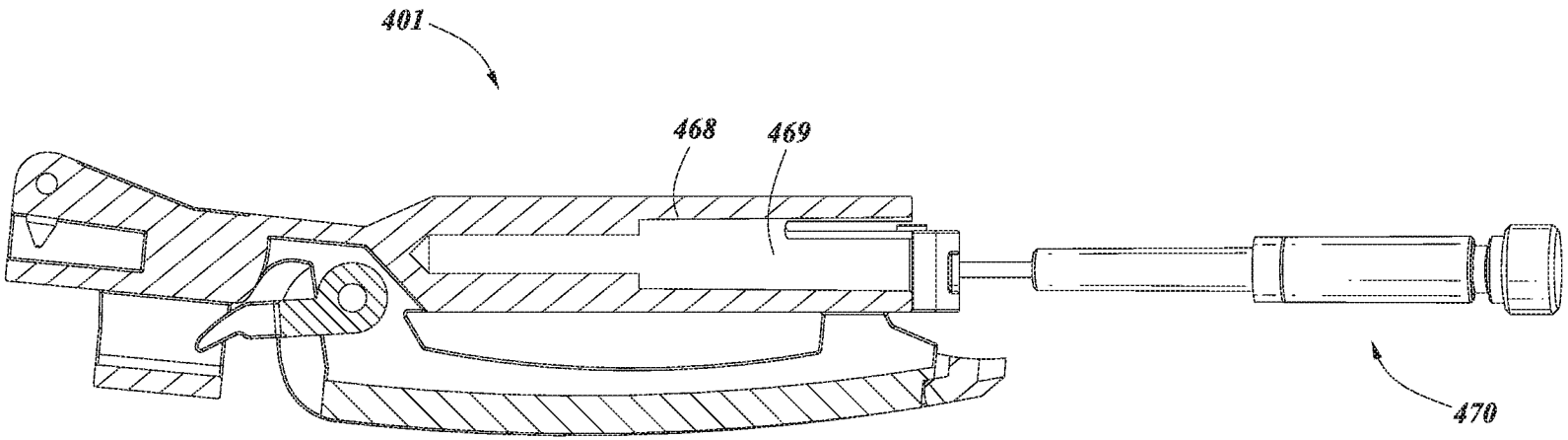
FIG. 33 is a cross section view of illustrative embodiment of the belt adjustment system of FIG. 32.

FIGS. 31-33 illustrate another embodiment of a belt adjustment system 401. The belt adjustment system 401 can include substantially the same features as described in relation to the belt adjustment system 301 with reference to FIGS. 21-29B. The belt adjustment system includes a buckle frame portion 308 and an a tool housing portion 440, including additional embodiments of the tool 450, cavity tool 470, and tool cavity portion 466 as described below.

A tool housing portion 440 is positioned under the buckle frame portion 308. The tool housing portion 440 can have an inner wall 442 and an outer wall 446 that can have substantially the same configuration as the inner wall 342 and the outer wall 346 described with reference to the belt adjustment system 301. The outer wall 446 and/or inner wall 442 extend substantially the width of the body 401*a* of the belt adjustment system 440. The outer wall 446 and/or inner wall may be contoured and have portions of the wall removed, such as cutout 444. The cutout 444 may be sized and shaped to accommodate one or more fingers in order to facilitate manipulation of the tool 450 by a person. In some embodiments, the inner wall and outer wall 446 are formed as a single component or as illustrated in FIG. 21. In some embodiments, the inner wall and outer wall are separate components that are coupled together. In some embodiments, one or more additional plates may be coupled to the outer wall and/or inner wall. The plates may be coupled to the body 401*a* with fasteners, welding, or other attachment mechanism known to those skilled in the art. The plates may be configured to increase the structural integrity of the belt adjustment system.

A tool slot formed by the inner wall 442 and outer wall 446 is configured to accommodate the tool 450 coupled to the body 401*a*. In the illustrated embodiment, the tool 450 is pivotally coupled to the body 401*a*. In some embodiments, the tool 450 may be linearly coupled to the body 401*a*. The tool 450 may be coupled to the body as further described above with reference to belt adjustment system 301. The outer wall 446 and inner wall can have contoured top edges that are configured to allow for a user to rotate and manipulate the tool 450 within the slot. A sharp end and/or edge of the tool 450 (such as blade edge 458) can be positioned within slot such that the sharp edge of the tool is not exposed and does not extend out of the slot when the tool 450 is in the closed position.

The tool 450 can be sized and configured to be positioned within the slot and coupled (e.g., pivotally) to the tool housing portion 440 between the inner wall and the outer wall 446. The tool 450 can be manipulated by a user between a closed position (FIG. 30) and an open position (FIG. 32). The tool 450 can be configured to be secured in the open position by a locking mechanism, such a biased plate or a spring, that functions to lock the tool in the open position. The biasing mechanism (such as, biasing mechanism 364 illustrated in FIG. 29A) can help to prevent the tool 450 from moving to the closed position unintentionally when in use by the user. The plate can biases to the locking position so that it moves behind the tool in the open position, thereby preventing the tool from closing. The biasing mechanism and/or the tool 450 can be manipulated by the user in order to move the tool 450 from the open position to the closed position, such as by pressing the biasing mechanism against the inner wall 342.

The illustrated tool 450 includes a number of features, such as a blade edge 458, a notch 462, and a hole 463. The hole 463 may be provided to facilitate grasping and manipulating the tool 450 by the user. In some embodiments, the hole 463 may be replaced with an indent or other feature to provide similar functionality. The tool 450 is shown for illustrative purposes and the belt adjustment system is not limited to the illustrated tool. Rather the tool 450 can be any type of tool that can be configured to be coupled to the belt adjustment system. In some embodiments, the tool 450 can incorporate additional functional elements, such as a knife blade, a bottle opener a nail pry, a scraper, a saw blade, a screwdriver (phillips, flat head, socket), can opener, and the like. The tool 450 can incorporate a single functional element, or incorporate any number of functional elements. In some embodiments, the tool 450 is securely coupled to the tool portion and cannot be easily removed without additional tools. In some embodiments, the tool 450 may be decoupled from the tool portion without the use of tools. For example, the tool 450 may include a quick release mechanism, such as a detent, that allows the tool to be held in place until it is decoupled from the belt adjustment system by the user. In such embodiments, the tool 450 may be usable without being coupled to the belt adjustment system 301. In some embodiments, the tool 450 is swappable and can be decoupled and replaced with a variety of tools. In some embodiments, more than one tool may be positioned within the slot 348. For example, a plurality of tools may be positioned within the slot 348, and each tool can be individually manipulated and moved between open and closed positions.

The tool housing portion 440 can also include a tool cavity portion 466. The tool cavity portion 466 can be positioned below the outer wall 446. The tool cavity portion 466 can be configured to house a cavity tool 470 within a cavity 469 (e.g., formed within the body 401*a*). FIG. 33 illustrates a cutout view of the interior of the cavity 469. In some embodiments, the tool cavity 480 is positioned between the inner wall and the outer wall 446. The inner cavity wall 468 forms the cavity 469. The inner cavity wall 468 can be sized and configured to engage a cavity tool 470. For example, in the illustrated embodiment, the inner cavity wall 468 includes two cylindrical, or substantially cylindrical, portions that match the shape of the cavity tool 470. The first portion has a larger diameter than the second portion. In some embodiments, the cavity 369 can be a different shape and size. The cavity 469 may be sized and shaped to match a different size or shaped tool. For example, the inner cavity wall 468 may be rectangular, oval, or another shape in order to accommodate the cavity tool. The cavity portion 466 can include slots or grooves 480 that extend at least a portion of the length of the cavity portion 466. The slots 480 extend though the outer cavity wall 467 to the interior cavity 469. The slots 480 form a tab 482 that can be configured to help secure the cavity tool within the cavity 469. The tab 482 can be function as a compliant mechanism to apply a securing force to the cavity tool 470 so that it remains in place. For example, the tab 482 can be biased inward toward the interior cavity 469. The tab 482 can elastically deform when the cavity tool 470 is inserted or removed from the cavity 469. The size and shape of the slots 480 and tab 482 can be configured to determine the amount of retention force applied to the cavity tool 470, and the amount of force required to remove the cavity tool 470 from the cavity 469. In some embodiments, the outer edge of the cavity 469 may include a lip or other protrusion to help secure the cavity tool 470 within the cavity.

The cavity tool 470 can be include a handle portion 472 and an upper body portion 474 and a lower body portion 476. The handle portion 472 is sized and configured to be positioned exterior to the cavity 469. The upper body portion 474 and the lower body portion 476 are sized and configured to be positioned within the cavity 469. In some embodiments, the cavity tool 470 can include a lip, protrusion, or seal to help secure the cavity tool 470 within the cavity 469. In an alternative embodiment, the cavity 369 can include a threaded engagement portion, such as on the outer cavity wall 467 or on the inner cavity wall 468. The threaded engagement can be used to securely mount the cavity tool 470 within the cavity 469.

In some embodiments, the lower body portion 476 can be a firestarter rod, such as a cerium mischmetal rod or a ferrocerium rod, for use in generating sparks to start a fire. In such an embodiment, a portion of the body 401*a* may be used as a striker for the firestarter rod to generate sparks. In some embodiments, the handle portion 472 and the upper body portion 474 may be a flashlight. The power supply for the flashlight can be positioned within the upper body portion 474, The power supply can be a battery or a plurality of batteries housed within the upper body portion 474. In some embodiments, the power supply may be a rechargeable power supply such as a lithium-ion battery. In some embodiments, the power supply may be accessibly by removing the handle portion 472 from the upper body portion 474. For example, the upper body portion may have a threaded engagement portion for coupling the handle portion 472 to the upper body portion 474.

While the embodiments of the disclosure have been described above, it will be recognized and understood that various modifications can be made to cover modifications which may fall within the spirit and scope of the disclosure. For example the tools 350 or 450, the cavity tools 370 or 470, and/or the location module 390 can be used with any of the other features disclosed herein.

What is claimed is:

1. A belt adjustment system, comprising:
a belt comprising a plurality of belt teeth;
a buckle comprising:
a belt clamp configured to couple the belt to the buckle;
a lever movable between a first position and a second position;
a tooth-engaging tab, the tooth-engaging tab positionable between a tooth-engaging position when the lever is in the first position, and a tooth-disengaging position when the lever is in the second position;
a tool housing comprising a first wall and a second wall, a slot formed between the first wall and the second wall;
a tool comprising a distal end and a proximal end, wherein the proximal end is coupled to the tool housing, the tool positionable between a closed position and an open position;
a second tool housing comprising an outer wall and an inner wall forming a cavity; and
a second tool comprising a tool handle at a proximal end, and a tool body extending out distally, wherein the tool body is configured to be positioned within the cavity.

2. The belt adjustment system of claim 1, wherein the second tool includes a firestarter rod.

3. The belt adjustment system of claim 2, wherein the second tool includes a flashlight positioned in the tool handle portion and the firestarter rod in the tool body.

4. The belt adjustment system of claim 1, wherein tool body is sized and shaped to match the shape of the inner wall.

5. The belt adjustment system of claim 1, further comprising a locking mechanism configured to lock the tool in the open position, wherein the locking mechanism is manipulatable by a user to move the tool to the closed position.

6. The belt adjustment system of claim 1, wherein the tool is a multitool comprising multiple functional elements.

7. The belt adjustment system of claim 1, wherein in the closed position, a distal end of the tool is disposed within the slot, and wherein in the open position the distal end is positioned outside of the slot.

8. A belt adjustment system, comprising:
a buckle comprising:
a belt clamp configured to couple a belt to the belt adjustment system;
a lever movable between a first position and a second position;
a belt-engaging element, the belt-engaging element positionable between a belt-engaging position when the lever is in the first position, and a belt-disengaging position when the lever is in the second position, wherein the belt-engaging member is configured to engage a belt positioned within a belt space of the belt adjustment system;
a tool housing comprising a first wall and a second wall, a slot formed between the first wall and the second wall; and
a tool comprising a distal end and a proximal end, wherein the proximal end is coupled to the tool housing, the tool positionable between a closed position and an open position;
a second tool housing comprising an outer wall and an inner wall forming a cavity; and
a second tool comprising a tool handle at a proximal end, and a tool body extending out distally, wherein the tool body is configured to be positioned within the cavity.

9. The belt adjustment system of claim 8, further comprising a locking mechanism configured to lock the tool in the open position, wherein the locking mechanism is manipulatable by a user to move the tool to the closed position.

10. The belt adjustment system of claim 8, wherein in the closed position, a distal end of the tool is disposed within the slot, and wherein in the open position the distal end is positioned outside of the slot.

11. The belt adjustment system of claim 8 wherein the tool handle is positioned exterior to the cavity when the tool body is positioned within the cavity.

12. The belt adjustment system of claim 8, wherein the tool is pivotally coupled to the tool housing portion.

13. The belt adjustment system of claim 8, wherein the tool is linearly coupled to the tool housing portion.

14. The belt adjustment system of claim 8, wherein a tool housing portion is configured to be positioned between the belt and a wearer of the belt.

15. The belt adjustment system of claim 8, wherein the cavity cylindrical.

16. The belt adjustment system of claim 8, wherein the second tool further comprises a seal configured to secure the second tool body within the cavity.

17. The belt adjustment system of claim 8, wherein the second tool housing further comprises a threaded engagement portion configured to secure the second tool within the cavity.

18. The belt adjustment system of claim 8, wherein the second tool housing comprises grooves that extend at least a portion of the cavity and form tabs that are configured to apply a securing force to secure the second tool within cavity.

19. The belt adjustment system of claim 8, wherein, when the second tool is removed from the second tool housing, the second tool decoupled and separate from the buckle.

* * * * *